US009251749B2

(12) United States Patent
Maruyama et al.

(10) Patent No.: US 9,251,749 B2
(45) Date of Patent: Feb. 2, 2016

(54) LIQUID CRYSTAL DISPLAY DEVICE WITH GREY-SCALE VOLTAGE CORRECTION

(75) Inventors: Junichi Maruyama, Chiba (JP); Ryutaro Oke, Chiba (JP); Yoshihisa Ooishi, Kanagawa (JP)

(73) Assignee: Panasonic Liquid Crystal Display Co., Ltd., Hyogo (JP)

( * ) Notice: Subject to any disclaimer, the term of this patent is extended or adjusted under 35 U.S.C. 154(b) by 370 days.

(21) Appl. No.: 13/371,003

(22) Filed: Feb. 10, 2012

(65) Prior Publication Data

US 2012/0229523 A1 Sep. 13, 2012

(30) Foreign Application Priority Data

Mar. 10, 2011 (JP) ..... 2011-052648

(51) Int. Cl.
*G09G 3/34* (2006.01)
*G09G 3/36* (2006.01)

(52) U.S. Cl.
CPC ..... *G09G 3/3648* (2013.01); *G09G 3/3688* (2013.01); *G09G 2310/0248* (2013.01); *G09G 2310/0281* (2013.01); *G09G 2320/0204* (2013.01); *G09G 2320/0219* (2013.01); *G09G 2320/0223* (2013.01); *G09G 2320/0257* (2013.01); *G09G 2320/0285* (2013.01)

(58) Field of Classification Search
CPC ..... G09G 3/3614
USPC ..... 345/96, 89, 690
See application file for complete search history.

(56) References Cited

U.S. PATENT DOCUMENTS

| | | | | |
|---|---|---|---|---|
| 8,044,914 | B2 * | 10/2011 | Lee et al. | 345/89 |
| 2004/0196243 | A1 | 10/2004 | Masutani et al. | |
| 2006/0152462 | A1 | 7/2006 | Furihata et al. | |
| 2006/0158413 | A1 | 7/2006 | Morita | |
| 2007/0057884 | A1 * | 3/2007 | Akai et al. | 345/89 |
| 2008/0012840 | A1 * | 1/2008 | Higashino et al. | 345/204 |
| 2008/0204439 | A1 | 8/2008 | Morita | |
| 2008/0224983 | A1 * | 9/2008 | Lee et al. | 345/98 |
| 2009/0040244 | A1 | 2/2009 | Lee et al. | |
| 2010/0045708 | A1 * | 2/2010 | Higashino | 345/89 |
| 2011/0043711 | A1 | 2/2011 | Tsuda et al. | |
| 2011/0205260 | A1 | 8/2011 | Weng et al. | |
| 2011/0221760 | A1 * | 9/2011 | Irie et al. | 345/589 |
| 2011/0234625 | A1 * | 9/2011 | Irie et al. | 345/690 |

FOREIGN PATENT DOCUMENTS

| | | | | |
|---|---|---|---|---|
| WO | 2009/133906 | | 11/2009 | |
| WO | WO 2010073775 | A1 * | 7/2010 | G09G 3/36 |
| WO | WO 2010087051 | A1 * | 8/2010 | G09G 3/36 |

* cited by examiner

*Primary Examiner* — Adam J Snyder
(74) *Attorney, Agent, or Firm* — Hamre, Schumann, Mueller & Larson, P.C.

(57) ABSTRACT

In the case where the gray-scale value of the pixel X is the minimum gray-scale value, the data line driving circuit (4) outputs a video signal having a voltage obtained by correcting the positive polarity minimum gray-scale voltage corresponding to the minimum gray-scale value only when outputting a positive polarity video signal. In the above, the data line driving circuit (4) outputs the video signal having the voltage obtained by correcting the positive polarity minimum gray-scale voltage, using a voltage correction amount larger than that which is used in outputting the video signal having the voltage obtained by correcting the positive polarity gray-scale voltage corresponding to the intermediate gray-scale value.

10 Claims, 22 Drawing Sheets

FIG.9A

P1, P8

| REPRESENTATIVE HORIZONTAL POSITION | GRAY-SCALE CORRECTION AMOUNT CANDIDATE (VOLTAGE CORRECTION AMOUNT) |
|---|---|
| 0 | 6 (584mV) |
| 120 | 0 (0mV) |
| 240 | 0 (0mV) |
| 360 | 0 (0mV) |
| 480 | 0 (0mV) |

FIG.9B

P2, P7

| REPRESENTATIVE HORIZONTAL POSITION | GRAY-SCALE CORRECTION AMOUNT CANDIDATE (VOLTAGE CORRECTION AMOUNT) |
|---|---|
| 0 | 5 (532mV) |
| 120 | 0 (0mV) |
| 240 | 0 (0mV) |
| 360 | 0 (0mV) |
| 480 | 0 (0mV) |

FIG.9C

P3, P6

| REPRESENTATIVE HORIZONTAL POSITION | GRAY-SCALE CORRECTION AMOUNT CANDIDATE (VOLTAGE CORRECTION AMOUNT) |
|---|---|
| 0 | 4 (480mV) |
| 120 | 4 (480mV) |
| 240 | 0 (0mV) |
| 360 | 0 (0mV) |
| 480 | 0 (0mV) |

FIG.9D

P4, P5

| REPRESENTATIVE HORIZONTAL POSITION | GRAY-SCALE CORRECTION AMOUNT CANDIDATE (VOLTAGE CORRECTION AMOUNT) |
|---|---|
| 0 | 4 (480mV) |
| 120 | 4 (480mV) |
| 240 | 4 (480mV) |
| 360 | 1 (120mV) |
| 480 | 0 (0mV) |

| REPRESENTATIVE HORIZONTAL POSITION | GRAY-SCALE CORRECTION AMOUNT CANDIDATE (VOLTAGE CORRECTION AMOUNT) |
|---|---|
| 0 | 5 (532mV) |
| 120 | 2 (240mV) |
| 240 | 1(120mV) |
| 360 | 0 (0mV) |
| 480 | 0 (0mV) |

FIG.19 -- Prior Art
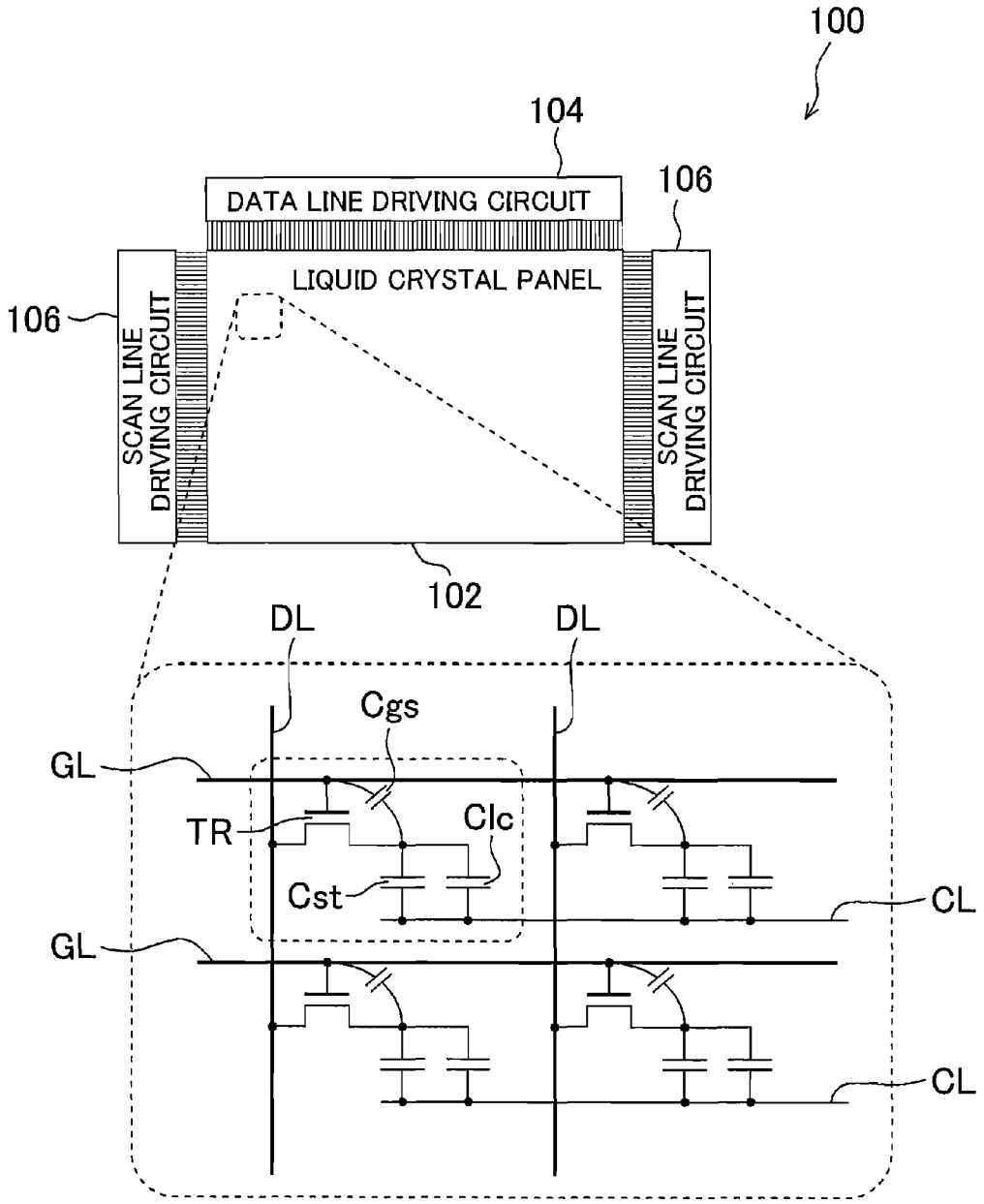

FIG.20 -- Prior Art
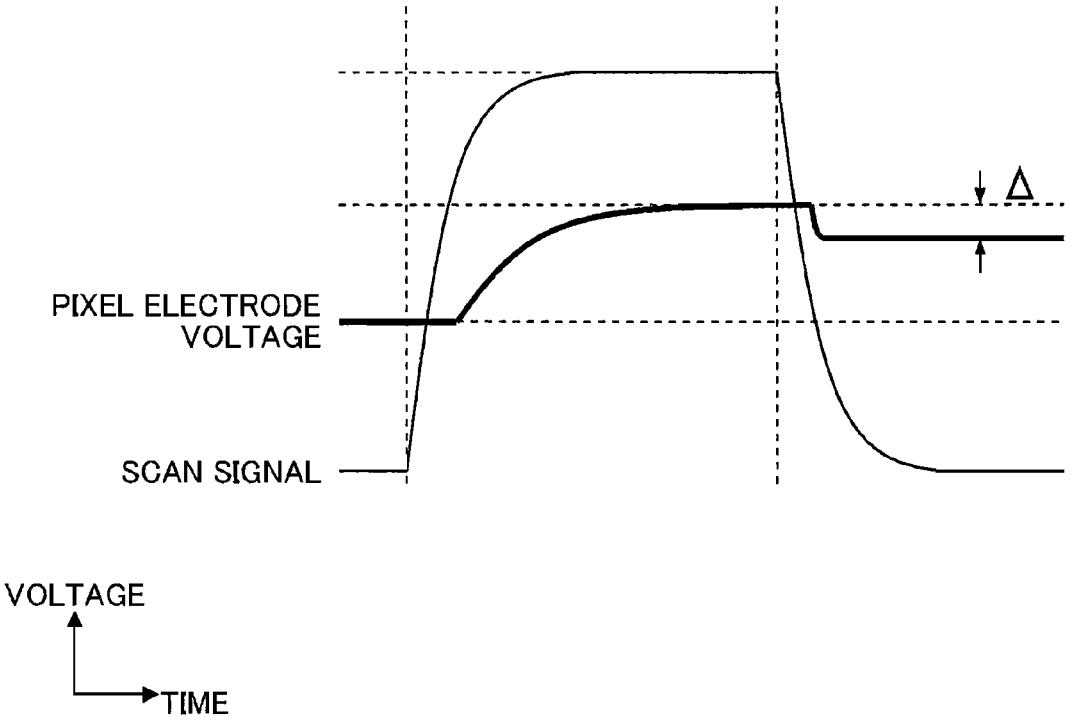

FIG.21 -- Prior Art
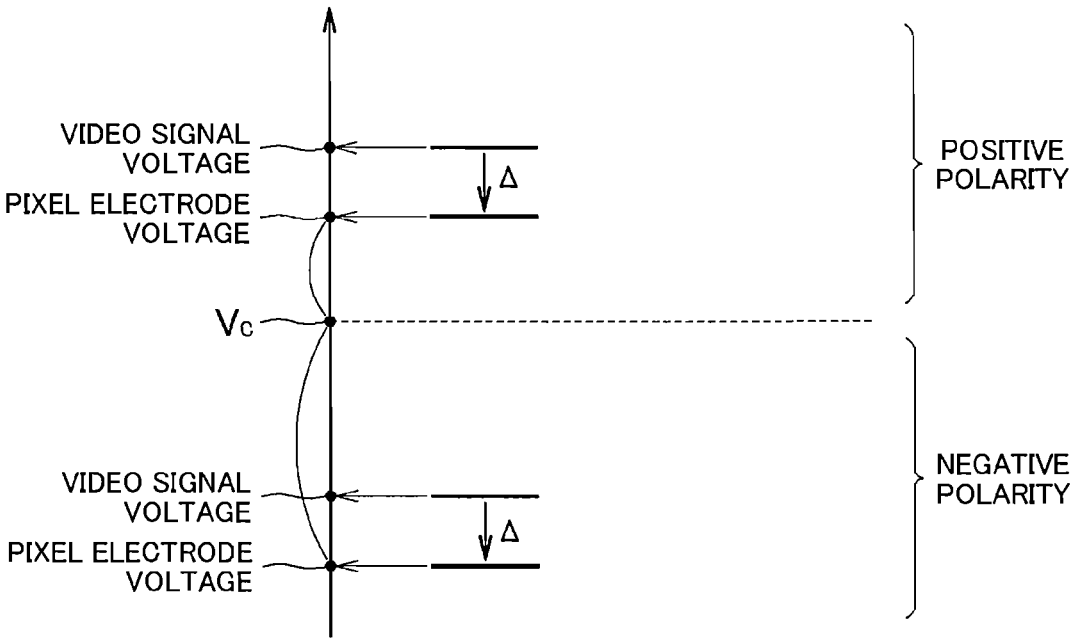
FIG.22 -- Prior Art
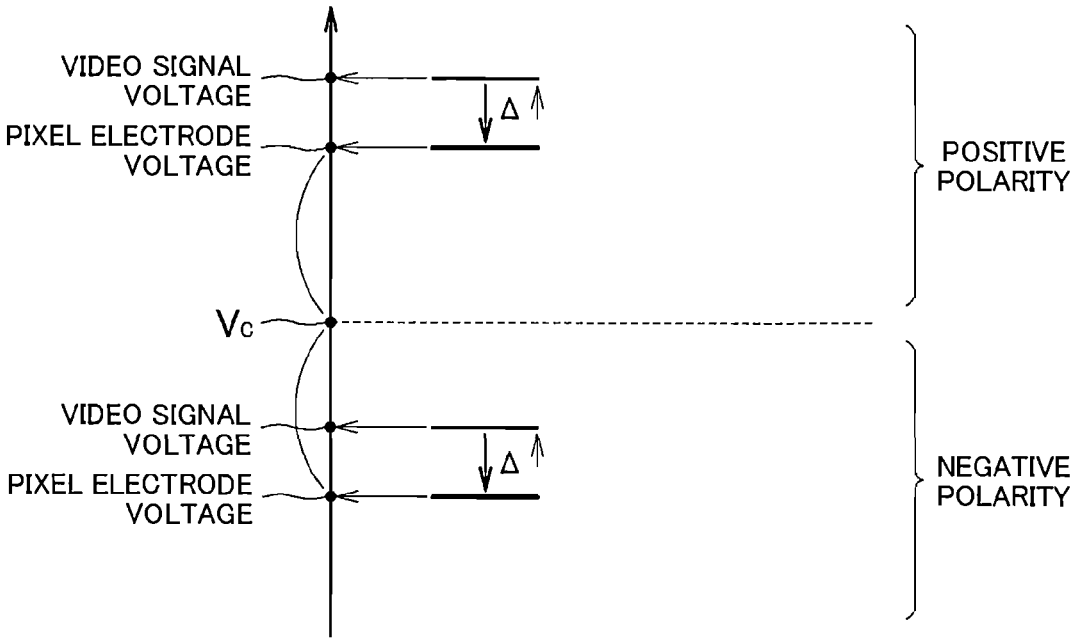

LIQUID CRYSTAL DISPLAY DEVICE WITH GREY-SCALE VOLTAGE CORRECTION

CROSS-REFERENCE TO RELATED APPLICATION

The present application claims priority from Japanese application 2011-052648 filed on Mar. 10, 2011, the content of which is hereby incorporated by reference into this applications.

BACKGROUND OF THE INVENTION

1. Field of the Invention

The present invention relates to a liquid crystal display device.

2. Description of the Related Art

FIG. 19 is a diagram showing a general liquid crystal display device 100. As shown in the diagram, the liquid crystal display device 100 mainly comprises a liquid crystal panel 102, a data line driving circuit 104, and a scan line driving circuit 106. Further, a data line DL vertically extending, a scan line GL horizontally extending, and a common line CL formed over common electrodes are formed on the liquid crystal panel 102, as shown in the enlarged diagram. Still further, as shown in the enlarged diagram, a TFT transistor TR, a pixel electrode, and a common electrode are formed in the pixel area enclosed by the data line DL and the scan line GL. Yet further, the pixel area additionally has parasitic capacitance Cgs between the gate and drain of the TFT transistor TR, pixel capacitance Clc between the pixel electrode and the common electrode, and auxiliary capacitance Cst.

The scan line driving circuit 106 selects the scan line GL, beginning with the one at the top, and outputs a scan signal to the selected scan line GL during one horizontal period. Meanwhile, the data line driving circuit 104 outputs a video signal to each data line DL for every selection of the scan line GL by the scan driving circuit 106.

In the above described liquid crystal display device 100, presence of the parasitic capacitance Cgs causes a field through phenomenon in which the voltage of the pixel electrode falls upon a fall of the voltage of the scan signal. FIG. 20 shows a field through phenomenon. As shown in the diagram, upon a fall of the scan signal, the voltage of a pixel electrode falls by an amount "Δ".

It has been known that because the symmetric property between the positive polarity voltage and the negative polarity voltage of a pixel electrode relative to the common voltage Vc is destroyed due to the field through phenomenon, as shown in FIG. 21, despite employment of a frame inversion method, such as a column line inversion driving method, a dot inversion driving method, and the like, in the liquid crystal display device 100, the pixel is charged with a DC charge, which consequently causes a defect of a so-called afterimage (or burn-in).

In view of the above, in a liquid crystal display device described in WO2009/133906A1, in order to avoid imbalance in polarity of the voltage of a pixel electrode into one polarity, the video signal output from the data line DC is corrected so that video signal at a higher voltage than usual is output (see FIG. 22). Further, according to WO2009/133906A1, considering that the amount Δ will change depending on the horizontal position of the pixel, the amount of correction to a video signal is adjusted according to the horizontal position of the pixel.

SUMMARY OF THE INVENTION

Suppose that, for example, the gray-scale value of a pixel and the voltage of a video signal have the relationship shown in FIG. 2A with respect to each other. In this case, even though it is wished when outputting a negative polarity video signal in the case where the gray-scale value of a pixel is "0" indicating the minimum gray-scale (hereinafter referred to as black gray-scale), to output a video signal at a higher voltage than the negative polarity gray-scale voltage "$V_{0-}$" corresponding to the gray-scale value "0", a voltage higher than the negative polarity gray-scale voltage "$V_{0-}$" cannot be output due to the structure of the data line driving circuit as the gray-scale value "0" is the minimum gray-scale. Therefore, when the gray-scale value of the pixel is "0" indicating black gray-scale, correction of a video signal is possible only when outputting a positive polarity video signal. Consequently, there is a problem that generation of an afterimage cannot be sufficiently prevented.

Further, when outputting a positive polarity video signal in the case where the gray-scale value of a pixel is "Dmax" indicating the maximum gray-scale (hereinafter referred to as white gray-scale) (see FIG. 2A), the data line driving circuit cannot output a signal at a voltage higher than the positive polarity gray-scale voltage "$V_{m+}$" corresponding to the gray-scale value "Dmax". Therefore, when the gray-scale value of a pixel is "Dmax" indicating white gray-scale, correction of a video signal is possible only when outputting a negative polarity video signal. Regarding this point as well, there is a problem that generation of an afterimage cannot be sufficiently prevented.

An object of the present invention is to prevent with high accuracy generation of an afterimage due to a pixel being charged with a DC current.

In order to achieve the above described object, according to one aspect of the present invention, there is provided a liquid crystal display device, comprising a plurality of data lines; a plurality of scan lines; a data line driving circuit for selectively outputting a positive polarity video signal or a negative polarity video signal of a pixel corresponding to a data line that is any of the plurality of data lines and a scan line that is any of the plurality of scan lines to the data line for every predetermined output cycle; and a scan line driving circuit for outputting a scan signal to the scan line when the video signal of the pixel is output, wherein the data line driving circuit, in a case where a gray-scale value of the pixel is an intermediate gray-scale value that is a gray-scale value other than a first gray-scale value indicating minimum gray-scale and a second gray-scale value indicating maximum gray-scale, outputs a video signal having a voltage obtained by correcting a positive polarity gray-scale voltage corresponding to the gray-scale value of the pixel when outputting the positive polarity video signal, and outputs a video signal having a voltage obtained by correcting a negative polarity gray-scale voltage corresponding to the gray-scale value of the pixel when outputting the negative polarity video signal, the data line driving circuit, in a case where the gray-scale value of the pixel is the first gray-scale value, outputs a video signal having a voltage obtained by correcting a first positive polarity gray-scale voltage corresponding to the first gray-scale value when outputting the positive polarity video signal, and outputs a video signal having a first negative polarity gray-scale voltage corresponding to the first gray-scale value when outputting the negative polarity video signal, the data line driving circuit, in a case where the gray-scale value of the pixel is the second gray-scale value, outputs a video signal having a second positive polarity gray-scale voltage corresponding to the second gray-scale value when outputting the positive polarity video signal, and outputs a video signal having a voltage obtained by correcting a second negative polarity gray-scale voltage corresponding to the second gray-scale value when outputting the negative polarity video signal, and the data line driving circuit carries out output of the video signal having the voltage obtained by correcting the first positive polarity gray-scale voltage, using a voltage correction amount larger than that which is used in outputting the video signal having the voltage obtained by correcting the positive polarity gray-scale voltage corresponding to the intermediate gray-scale value, and carries out output of the video signal having the voltage obtained by correcting the second negative polarity gray-scale voltage, using a voltage correction amount larger than that which is used in outputting the video signal having the voltage obtained by correcting the negative polarity gray-scale voltage corresponding to the intermediate gray-scale value.

In one embodiment of the present invention, the data line driving circuit may change for every predetermined cycle the voltage correction amount that is used in outputting the video signal having the voltage obtained by correcting the first positive polarity gray-scale voltage and that which is used in outputting the video signal having the voltage obtained by correcting the second negative polarity gray-scale voltage.

In one embodiment of the present invention, the liquid crystal display device may further comprise a production circuit for producing a corrected gray-scale value when the gray-scale value of the pixel is either the first gray-scale value or the second gray-scale value by correcting the gray-scale value of the pixel, based on a correction amount candidate group including a plurality of correction amount candidates, and an output circuit for selectively outputting either one of the gray-scale value itself of the pixel and the corrected gray-scale value produced by the production circuit when the gray-scale value of the pixel is either the first gray-scale value or the second gray-scale value, wherein when the gray-scale value of the pixel is the first gray-scale value, the data line driving circuit may output a video signal having the first negative polarity gray-scale voltage in response to the gray-scale value itself of the pixel output from the output circuit and output a video signal having a positive polarity voltage corresponding to the corrected gray-scale value in response to the corrected gray-scale value output from the output circuit, when the gray-scale value of the pixel is the second gray-scale value, the data line driving circuit may output a video signal having the second positive polarity gray-scale voltage in response to the gray-scale value itself of the pixel output from the output circuit and output a video signal having a negative polarity voltage corresponding to the corrected gray-scale value in response to the corrected gray-scale value output from the output circuit, and the production circuit may switch the correction amount candidate groups for use in correcting the gray-scale value of the pixel for every predetermined cycle.

In one embodiment of the present invention, the correction amount candidates included in the correction amount candidate group may be correlated to respective different horizontal positions, and the production circuit may carry out an interpolation operation based on the correction amount candidate included in the correction amount candidate group, a horizontal position of the pixel, and the horizontal positions correlated to the respective correction amount candidates, to thereby determine a correction amount.

In one embodiment of the present invention, the production circuit may determine a correction amount, based on a different correction amount candidate group between a case in which the gray-scale value of the pixel is the first gray-scale value and a case in which the gray-scale value of the pixel is the second gray-scale value.

In one embodiment of the present invention, the predetermined cycle may have a length longer than a polarity inversion cycle of the data line driving circuit.

In one embodiment of the present invention, the data line driving circuit may carry out output of the video signal having the voltage obtained by correcting the first positive polarity gray-scale voltage and output of the video signal having the voltage obtained by correcting the second negative polarity gray-scale voltage such that an average of the voltage correction amounts becomes larger with respect to a shorter distance of the pixel from the scan line driving circuit.

In one embodiment of the present invention, the data line driving circuit may carry out output of the video signal having the voltage obtained by correcting the first positive polarity gray-scale voltage and output of the video signal having the voltage obtained by correcting the second negative polarity gray-scale voltage such that an average of the voltage correction amounts becomes an amount according to a function value of a reduction exponential function including as a variable a distance of the pixel from the scan line driving circuit.

In one embodiment of the present invention, the scan line driving circuit may output a scan signal to the scan line during a horizontal period having a predetermined length, and the data line driving circuit may output the video signal during a partial second half period including an ending period of the horizontal period and a signal having a voltage higher or lower than the video signal during a first half period that is a period of the horizontal period excluding the second half period when outputting the positive polarity video signal and output the video signal during the second half period and a signal having the voltage higher or lower than the video signal during the first half period when outputting the negative polarity video signal.

BRIEF DESCRIPTION OF THE DRAWINGS

FIG. 9A is a diagram explaining an operation of the vertical line correction circuit;

FIG. 9B is a diagram explaining an operation of the vertical line correction circuit;

FIG. 9C is a diagram explaining an operation of the vertical line correction circuit;

FIG. 9D is a diagram explaining an operation of the vertical line correction circuit;

FIG. 19 is a diagram showing a general liquid crystal display device;

FIG. 20 is a diagram showing a field through phenomenon;

FIG. 21 is a diagram showing an asymmetric property between the positive polarity voltage of a pixel electrode and the negative polarity voltage of the pixel electrode relative to a common voltage; and FIG. 22 is a diagram showing a video signal being corrected.

DETAILED DESCRIPTION OF THE INVENTION

In the following, an embodiment of the present invention will be described in detail with reference to the accompanying drawings.

[Liquid Crystal Display Device]

Figure 1:
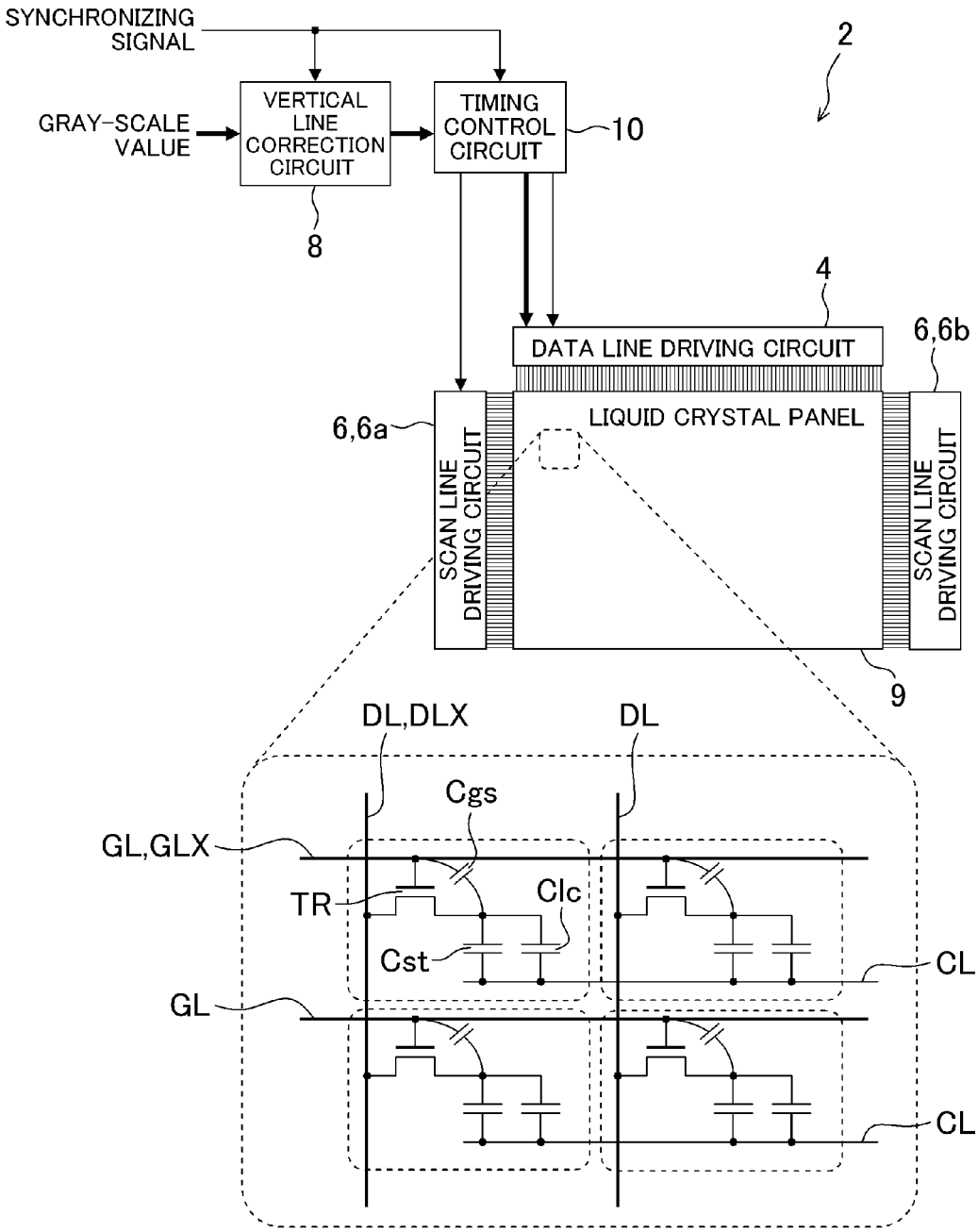
FIG. 1 is a diagram showing a liquid crystal display device according to an embodiment of the present invention.

FIG. 1 is a diagram showing a liquid crystal display device 2 according to an embodiment of the present invention. The liquid crystal display device 2 comprises a liquid crystal panel 9, a data line driving circuit 4 provided on an upper part of the liquid crystal panel 9, scan line driving circuits 6*a*, 6*b* provided to the left and right of the liquid crystal panel 9, respectively, a vertical line correction circuit 8, and a timing control circuit 10. The liquid crystal display device 2 additionally comprises a reference voltage producing circuit (not shown), a common voltage producing circuit (not shown), a backlight (not shown), and so forth. In this embodiment, a liquid crystal panel of an IPS (In Plane Switching) system is employed, however, a liquid crystal panel of, e.g., TN (Twisted Nematic) system or a VA (Vertical Alignment) system may be employed. Note that the scan line driving circuit 6*a* and the scan line driving circuit 6*b* may be collectively referred to as a scan line driving circuit 6.

As shown in the enlarged diagram, the liquid crystal panel 9 has a plurality of data lines DL extending in the vertical direction, a plurality of scan lines GL extending in the horizontal direction, common electrodes, common lines CL each formed over a plurality of common electrodes, a plurality of pixels each enclosed by the data line DL and the scan line GL. A common voltage Vc is supplied to each common line CL by the common voltage producing circuit. As shown in the enlarged diagram, one pixel has a TFT transistor TR, parasitic capacitance Cgs between the gate and drain of the TFT transistor TR, pixel capacitance Clc between the pixel electrode and the common electrode, and auxiliary capacitance Cst. The pixel capacitance Clc comprises a pixel electrode and a common electrode. Note that a so-called stripe arrangement is employed as a pixel arrangement method in this embodiment.

Bit data indicating the gray-scale value of each pixel is input to the vertical line correction circuit 8.

The scan line driving circuit 6 selects the scan line GL, beginning with the one at the top, for every horizontal period according to a timing control signal from the timing control circuit 10, and outputs a scan signal to the selected scan line. Further, the data line driving circuit 4 outputs a video signal to each data line DL for every selection of the scan line GL by the scan line driving circuit 6 according to a timing control single.

That is, focusing on any scan line GLX (e.g., the top scan line GL) among the plurality of scan lines GL and any data line DLX (e.g., the leftmost data line DL) among the plurality of data lines DL, the scan line driving circuit 6 selects the scan line GLX (one scan line) at a frame time interval according to the timing control signal, and keeps outputting the scan signal to the scan line GLS during one horizontal period. Further, according to the timing control signal, the data line driving circuit 4 outputs a video signal according to the gray-scale value of a pixel at a position where the scan line GLX intersects the data line DLX (hereinafter referred to as a pixel X) to the data line DLX (one data line) while the scan single is kept output to the scan line GLX.

Note that a product between the total number of the scan lines GL and one horizontal period is a frame time. A period during which the scan line GLX is kept selected is hereinafter referred to as one horizontal period.

In the following, "a video signal kept output to the data line DLX during one horizontal period" will be referred to as "a video signal of the pixel X".

In this liquid crystal display device 2, a frame inversion method is employed, and the polarity of a video signal output from the data line driving circuit 4 is inverted at a frame time interval. The data line driving circuit 4 selectively outputs either one of the negative polarity video signal and the positive polarity video signal of the pixel X to the data line DLX at the frame time interval.

Note that as a column inversion driving method, or one type of the frame inversion method, is employed in this embodiment, the polarity of the video signal of the pixel X output from the data line DLX is opposite from the polarities of the video signals of the respective pixels to the left and right of the pixels X.

[Gray-Scale Voltage]

Figure 2A:
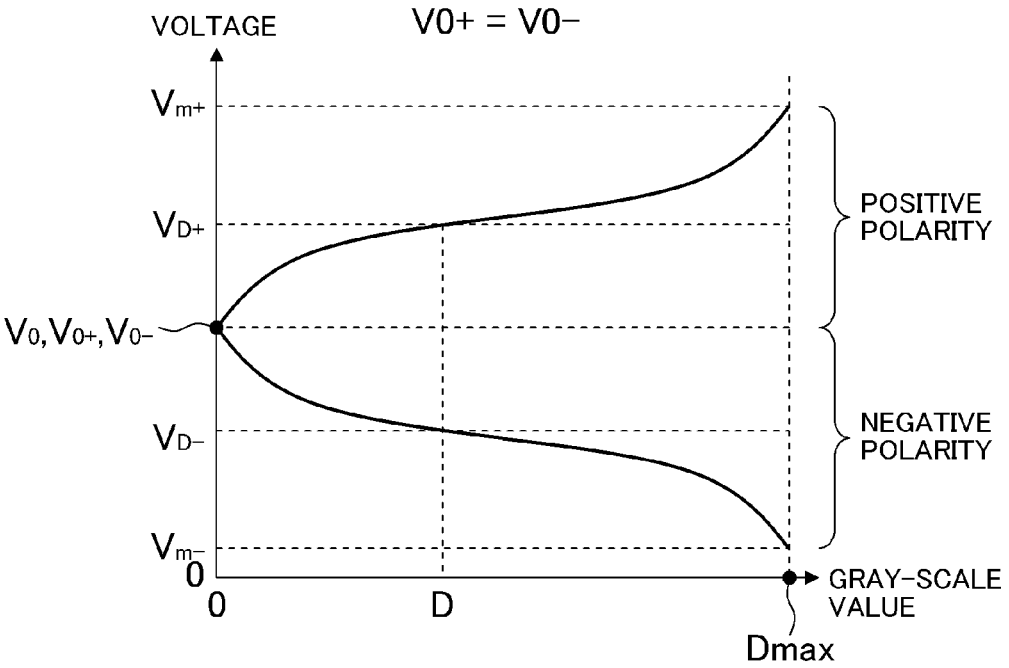
FIG. 2A is a diagram showing a relationship between a gray-scale value and a gray-scale voltage.
Figure 2B:
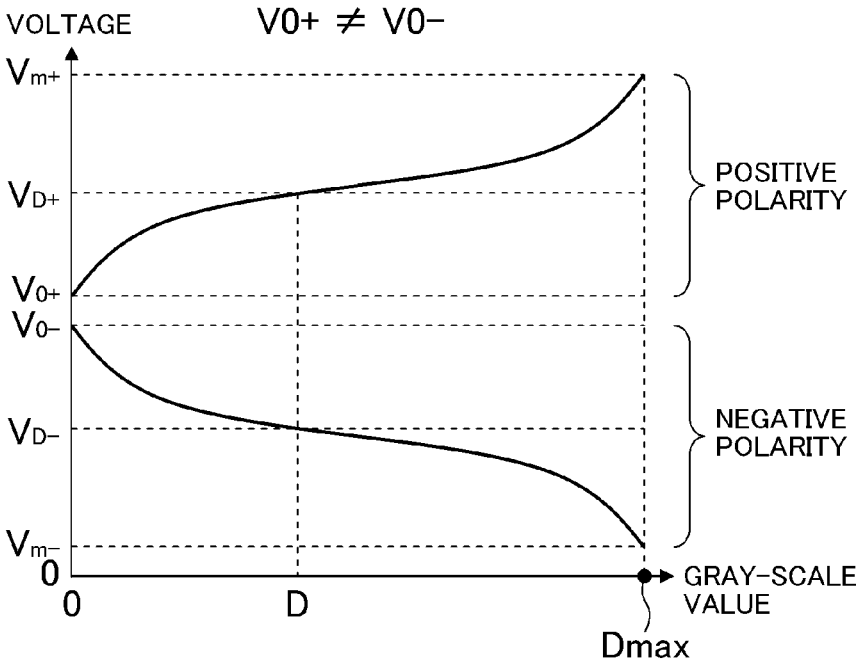
FIG. 2B is a diagram showing a relationship between a gray-scale value and a gray-scale voltage.

FIGS. 2A and 2B are diagrams showing a relationship between a gray-scale value and a gray-scale voltage corresponding to the gray-scale value, the relationship being set in advance on the data line driving circuit 4. In this embodiment, a gray-scale value and a gray-scale voltage corresponding to the gray-scale value have the relationship shown in FIG. 2A with respect to each other. According to FIG. 2A, a negative polarity gray-scale voltage corresponding to a gray-scale value "D" is denoted as "$V_{D-}$", while a positive polarity gray-scale voltage corresponding to a gray-scale value "D" is denoted as "$V_{D+}$". According to FIG. 2A, for the gray-scale value "D" being the minimum gray-scale value "0" indicating the minimum gray-scale (hereinafter referred to as black gray-scale), the negative polarity gray-scale voltage "$V_{0-}$" and positive polarity gray-scale voltage "$V_{0+}$" corresponding to the minimum gray-scale value "D" are both "$V_0$". In FIG. 2A, the average of "$V_{D-}$" and "$V_{D+}$" is always "$V_0$".

A common voltage Vc (not shown), which is the voltage of a common electrode, is set to a value (that is, "$V_0-\Delta v$") lower than the center voltage ($V_0$ in this case), which is the average of "$V_{D+}$" and "$V_{D-}$", by about $\Delta v$. That is, it is set such that "$V_{D+}-\Delta v$" and "$V_{D-}-\Delta v$" are symmetric to each other relative to the common voltage Vc. In the above, Δv is set to the amount of a voltage drop that is caused at the middle horizontal position, or the position in the horizontal direction at the middle of the liquid crystal panel 9, due to a field through phenomenon to be described later.

As shown in FIG. 2A, no voltage corresponding to the maximum gray-scale value (a second gray-scale value) "Dmax" indicating the maximum gray-scale (hereinafter referred to as white gray-scale) or larger is set as to either positive or negative polarity. Thus, the data line driving circuit 4 cannot output a voltage either higher than the positive polarity voltage "$V_{m+}$" corresponding to the maximum gray-scale value "Dmax" or lower than the negative polarity voltage "$V_{m-}$" corresponding to the maximum gray-scale value "Dmax" in this embodiment.

The gray-scale voltage "$V_{0-}$" is not necessary the same voltage as the gray-scale voltage "$V_{0+}$", and a gray-scale value and a gray-scale voltage corresponding to the gray-scale value may have the relationship shown in, e.g., FIG. 2B.

[Outline of Operation of Data Line Driving Circuit]

Below, an operation of the data line driving circuit 4 will be outlined with reference to FIGS. 3A to 7, taking as an example, a case of outputting a video signal of the pixel X. The voltage of the pixel electrode of the pixel X will be hereinafter referred to as "the voltage of the pixel X".

Figure 3A:
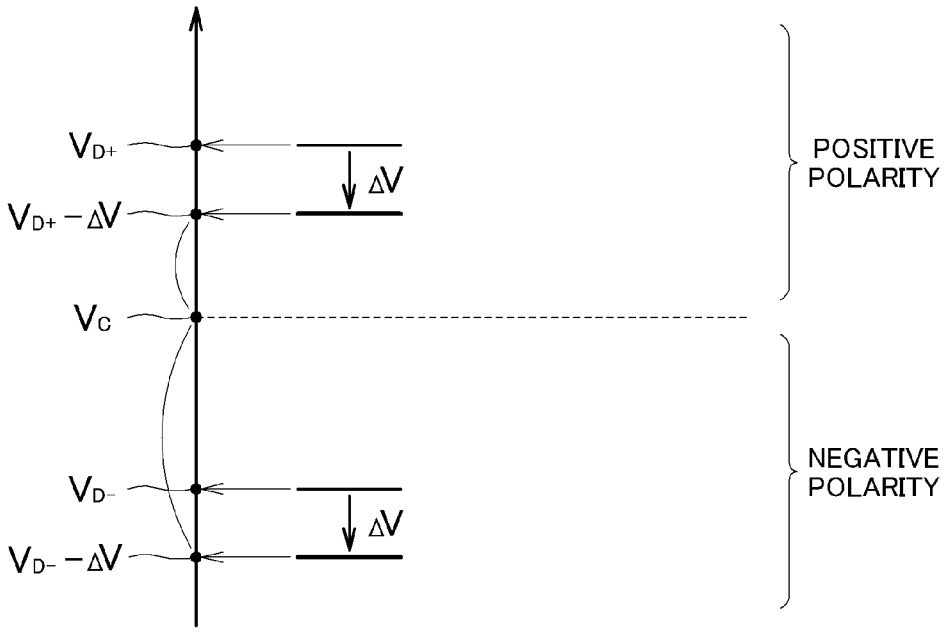
FIG. 3A is a diagram outlining an operation of a data line driving circuit.

In the liquid crystal display device 2, presence of parasitic capacitance Cgs causes a field through phenomenon in which the voltage of the pixel electrode of the pixel X falls in response to a fall of the scan signal output to the scan line GLX. Therefore, when the data line driving circuit 4 outputs a gray-scale voltage "$V_{D+}(V_{D-})$" corresponding to the gray-scale value of the pixel X as a video signal of the pixel X from the data line DLX, the voltage of the pixel X drops exceeding the video signal "$V_{D+}(V_{D-})$" by "ΔV" (ΔV≥Δv). Accordingly, as shown in FIG. 3A, the symmetric property between the positive polarity voltage "$V_{D+}-\Delta V$" and the negative polarity voltage "$V_{D-}-\Delta V$" of the pixel X relative to the common voltage Vc is destroyed, and consequently, the pixel X is charged with a DC charge. This causes an afterimage.

Figure 3B:
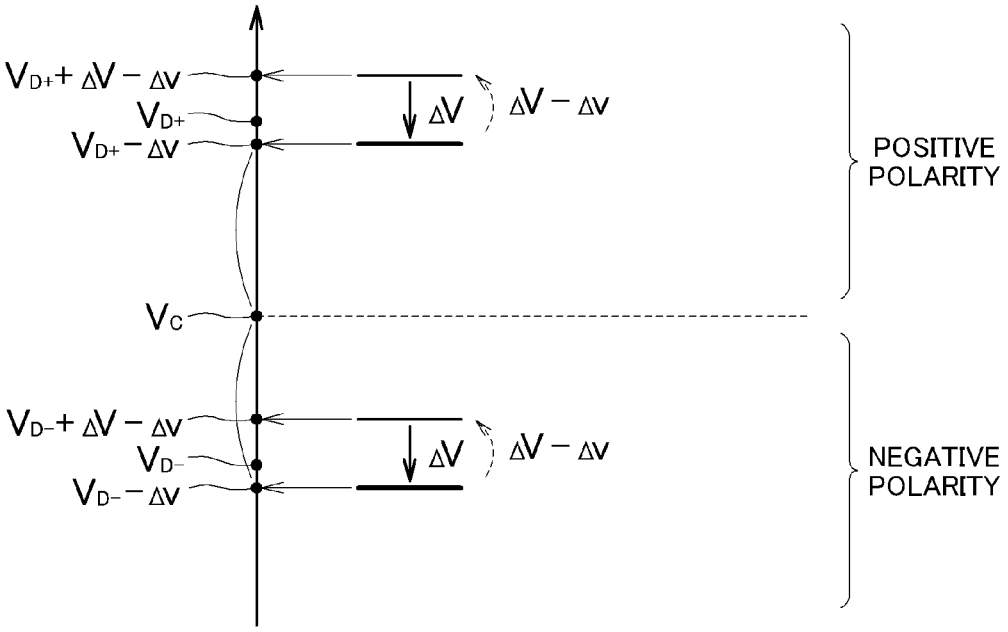
FIG. 3B is a diagram outlining an operation of the data line driving circuit.

In view of the above, as shown in FIG. 3B, when outputting a video signal of the pixel X to the data line DLX in the liquid crystal display device 2, the data line driving circuit 4 outputs a positive polarity video signal having the voltage "$V_{D+}+\Delta V-\Delta v$" obtained by correcting the positive polarity gray-scale voltage "$V_{D+}$" corresponding to the gray-scale value of the pixel X to output a positive polarity video signal, and outputs a negative polarity video signal having the voltage "$V_{D-}+\Delta V-\Delta v$" obtained by correcting the negative polarity gray-scale voltage "$V_{D-}$" corresponding to the gray-scale value of the pixel X to output a negative polarity video signal. Consequently, as shown in FIG. 3B, the symmetric property between the positive polarity voltage "$V_{D+}+\Delta V-\Delta v-\Delta V$" (that is, $V_{D+}-\Delta v$) and the negative polarity voltage "$V_{D-}+\Delta V-\Delta v-\Delta V$" (that is, $V_{D-}-\Delta v$) relative to the common voltage Vc (that is, "$V_0-\Delta v$") can be maintained.

Note that, however, when outputting a negative polarity video signal of the pixel X having the gray-scale value being the maximum gray-scale value "0", output of "$V_0+\Delta V-\Delta v$" obtained by reducing the minimum gray-scale value "0" is impossible as the minimum gray-scale value "0" cannot be reduced.

Figure 4:
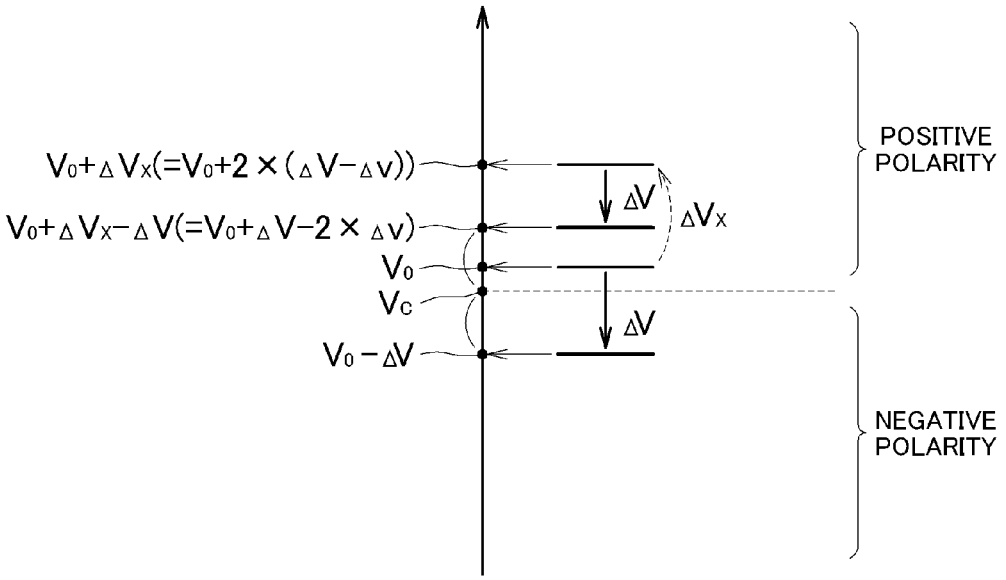
FIG. 4 is a diagram outlining an operation of the data line driving circuit.

To address the above, in this liquid crystal display device 2, as shown in FIG. 4, in the case where the gray-scale value of the pixel X is the minimum gray-scale value "0", the data line driving circuit 4 outputs a video signal having the negative polarity gray-scale voltage "$V_0$" corresponding to the minimum gray-scale value "0" when outputting a negative polarity video signal of the pixel X, and outputs a video signal having the voltage "$V_0+\Delta Vx$" obtained by correcting "$V_0$", using a voltage correction amount ΔVx that is larger than the voltage correction amount "ΔV−Δv", when outputting a positive polarity video signal of the pixel X. In the above, assume that ΔVx is a voltage amount twice as large as "ΔV−Δv". Therefore, even when the gray-scale value of the pixel X is the minimum gray-scale value "0", the symmetric property between the positive polarity voltage "$V_0+\Delta V-2\times\Delta v$" and negative polarity voltage "$V_0-\Delta V$" of the pixel X relative to the common voltage Vc can be maintained.

Figure 5:
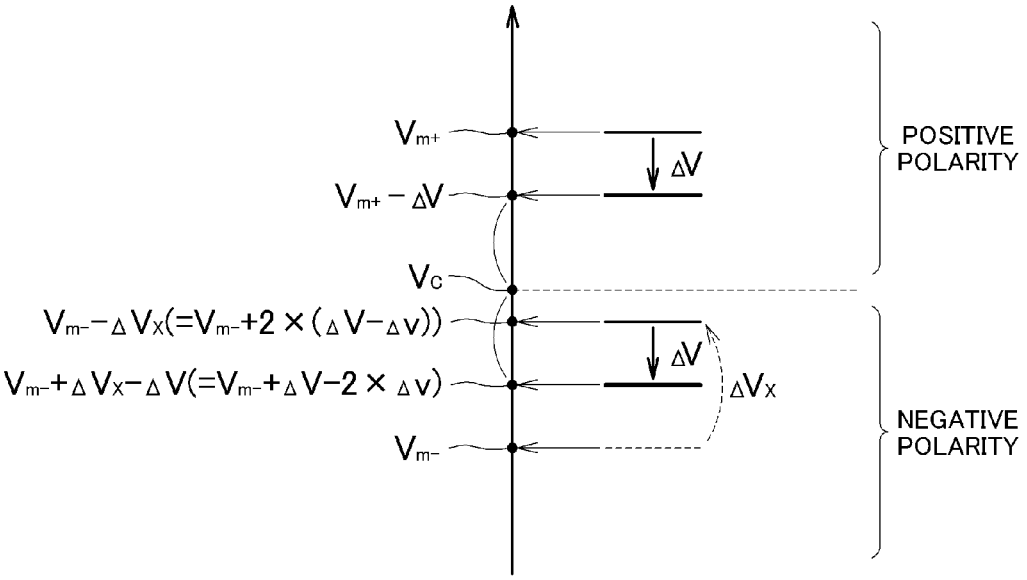
FIG. 5 is a diagram outlining an operation of the data line driving circuit.
Figure 6:
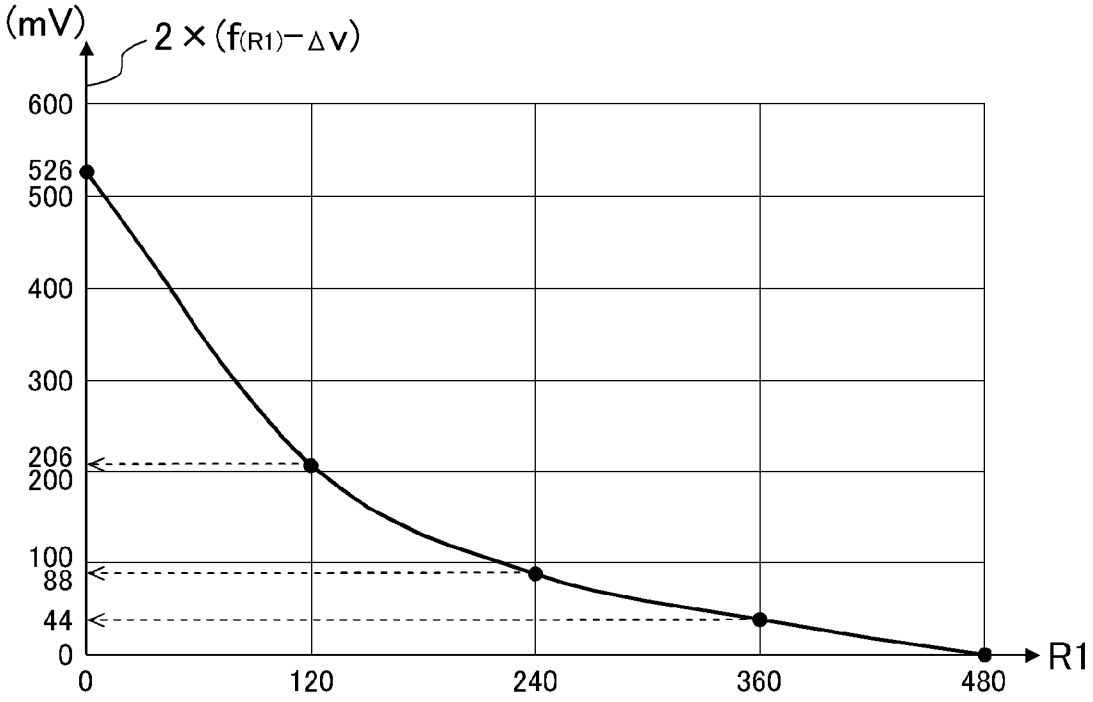
FIG. 6 is a diagram outlining an operation of the data line driving circuit.

Further, in this liquid crystal display device 2, as shown in FIG. 5, in the case where the gray-scale value of the pixel X is the maximum gray-scale value "Dmax", the data line driving circuit 4 outputs a video signal having the positive polarity gray-scale voltage "$V_{m+}$" (see FIG. 2) corresponding to the maximum gray-scale value "Dmax" when outputting a positive polarity video signal of the pixel X, and outputs a video signal having the voltage "$V_{m-}+\Delta Vx$" obtained by correcting the negative polarity gray-scale voltage "$V_{m-}$" corresponding to the maximum gray-scale value "Dmax", using the voltage correction amount "ΔVx" that is larger than "ΔV−Δv", when outputting a negative polarity video signal of the pixel X. Therefore, even when the gray-scale value of the pixel X is the maximum gray-scale value "Dmax", the symmetric property between the positive polarity voltage "$V_{m+}-\Delta V$" of the pixel X and the negative polarity voltage "$V_{m-}+\Delta V-2\times\Delta v$" of the pixel X relative to the common voltage Vc can be maintained.

The voltage drop amount ΔV due to a field through phenomenon will change depending on the distance R1 of the pixel X from the scan line driving circuit 6*a*. That is, the voltage drop amount ΔV becomes larger with respect to a shorter distance R1. The voltage drop amount ΔV will change also depending on the distance R2 of the pixel X from the scan line driving circuit 6*b*. That is, the voltage drop amount ΔV becomes larger with respect to a shorter distance R2. Specifically, the voltage drop amount V is approximated by a function value f (R1) of a function f including the distance R1 as a variable.

In detail, when the distance R1 is equal to or shorter than the distance W from the middle horizontal position of the scan line driving circuit 6*a*, the function f is approximated by a function value of a reduction exponential function f1(R1) mentioned below including the distance R1 as a variable.

$$f1=\Delta v+B\times\exp(-R1/C)$$

In the above, "B", "C" are constants that are determined based on the characteristic of the liquid crystal panel 9, in particular, "B" being a constant based on a so-called feed through voltage, and "C" being a constant based on a wire delay of the scan line. Further, the distance between the scan line driving circuit 6*a* and the scan line driving circuit 6*b* is 2×W. Note that when R1 is the distance W, f1(R1) becomes Δv.

When the distance R1 is longer than the distance W, the function f is approximated by the function value f2(R1) of the exponential function f2 mentioned below including the distance R1 as a variable.

$$f2=\Delta v+B\times\exp(-((2\times W-R1)/C))$$

Note that "2×W−R1" corresponds to R2.

As described above, the voltage drop amount ΔV is approximated by the function value f (R1) of the function f. Thus, in this liquid crystal display device 2, the data line driving circuit 4 carries out output of the positive polarity video signal "$V_{D+}+\Delta V-\Delta v$" of the pixel X when the pixel X has the gray-scale value (hereinafter referred to as an intermediate gray-scale value) other than the maximum gray-scale value and the minimum gray-scale value and output of the negative polarity video signal "$V_{D-}+\Delta V-\Delta v$" of the pixel X when the pixel X has an intermediate gray-scale value such that the voltage correction amount "$\Delta V-\Delta v$" becomes the ideal voltage correction amount "f(R1)−Δv".

Further, in the liquid crystal display device 2, the data line driving circuit 4 carries out output of the positive polarity video signal"$V_0+\Delta Vx$" of the pixel X when the pixel X has the minimum gray-scale value "0" and output of the negative polarity video signal "$V_{m-}+\Delta Vx$" of the pixel X when the pixel X has the maximum gray-scale value "Dmax" such that the voltage correction amount "ΔVx" becomes the ideal voltage correction amount "2×(f(R1)−Δv)". The curved line shown in FIG. 6 indicates the ideal voltage correction amount "2×(f(R1)−Δv)".

Note that in this embodiment, the data line driving circuit 4 changes the voltage correction amount "ΔVx" in outputting the positive polarity video signal "$V_0+\Delta Vx$" of the pixel X and the negative polarity video signal "$V_{m-}+\Delta Vx$" of the pixel X at a predetermined switching time interval, as to be described later. Therefore, in this embodiment, the data line driving circuit 4 carries out output of the video signal "$V_0+\Delta Vx$" and output of the video signal "$V_{m-}+\Delta Vx$" such that the average of the voltage correction amounts "ΔVx" becomes "2×(f(R1)−Δv)".

Figure 7:
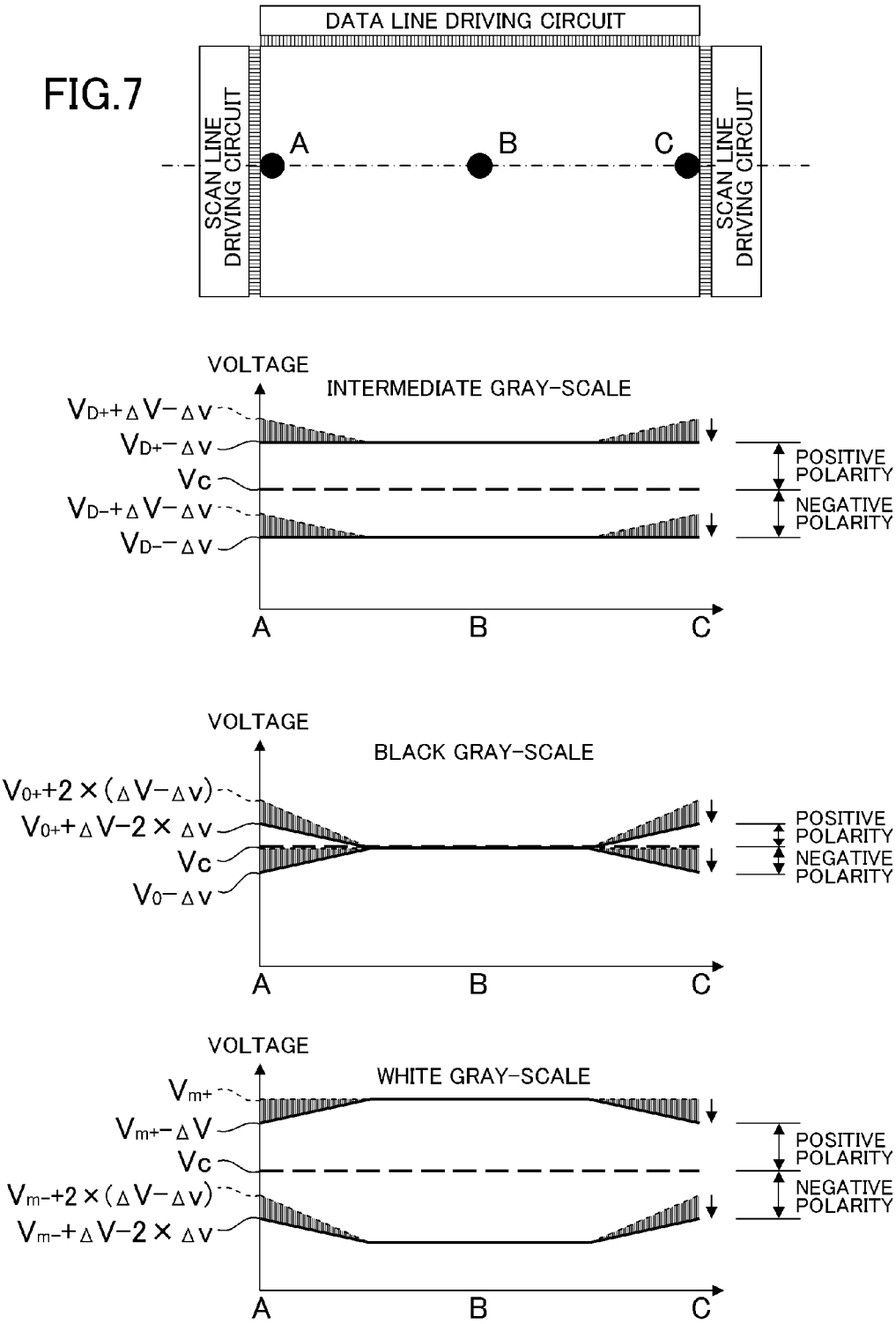
FIG. 7 is a diagram outlining an operation of the data line driving circuit.

As the data line driving circuit 4 operates as described above, in this liquid crystal display device 2, even though the gray-scale value of the pixel X is the maximum or minimum gray-scale value, the symmetric relationship between the positive polarity voltage and negative polarity voltage of the pixel X relative to the common voltage Vc is maintained regardless of the position of the pixel X in the horizontal direction (hereinafter referred to as a horizontal position), as shown in FIG. 7. Consequently, the pixel X is unlikely charged by a DC charge, and generation of an afterimage is more accurately prevented.

[Vertical Line Correction Circuit]

An operation of the vertical line correction circuit 8 for causing the data line driving circuit 4 to operate as described above will be described referring to FIGS. 8 to 13.

Figure 8:
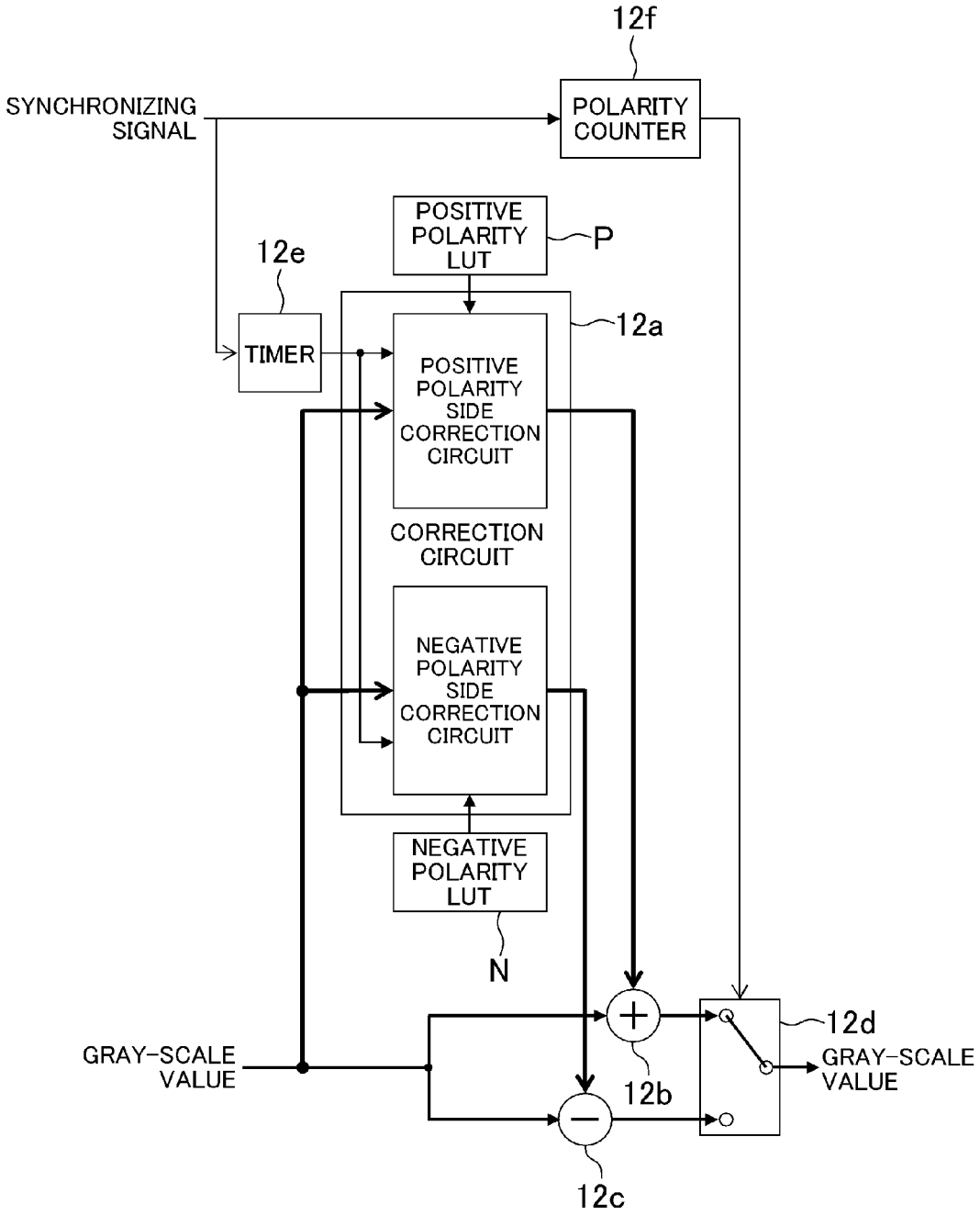
FIG. 8 is a diagram explaining an operation of a vertical line correction circuit.

FIG. 8 is a diagram showing a structure of the vertical line correction circuit 8. As shown in the diagram, the vertical line correction circuit 8 has eight look-up tables P1 to P8 for positive polarity, shown in FIGS. 9A to 9D, eight look-up tables N1 to N8 (not shown) for negative polarity, a correction circuit 12*a* comprising a positive polarity side correction circuit and a negative polarity side correction circuit, an addition circuit 12*b*, a subtraction circuit 12*c*, a switch 12*d*, a timer 12*e*, and a polarity counter 12*f*. The vertical line correction circuit 8 additionally has a horizontal counter (not shown), besides the members mentioned above.

Below, the look-up tables P1 to P8 are collectively referred to as a look-up table P, while the look-up tables N1 to N8 are collectively referred to as a look-up table N.

The look-up table P is a table for correlating each of the plurality of representative horizontal positions selected from among all of the horizontal positions in the liquid crystal panel 9 to a gray-scale correction amount candidate (see FIGS. 9A to 9D). The look-up table P is stored in advance. In this embodiment, five respective representative horizontal positions are correlated to respective gray-scale correction amount candidates. FIG. 9A shows look-up tables P1, P8; FIG. 9B shows look-up tables P2, P7; FIG. 9C shows look-up tables P3, P6; FIG. 9D shows look-up tables P4, P5 A numeric value identifying a representative horizontal position indicates the distance from the scan line driving circuit 6. A numeric value in a parenthesis indicates a voltage correction amount corresponding to the gray-scale correction amount candidate.

A gray-scale correction amount candidate set in each look-up table P is determined in consideration of the ideal voltage correction amount (that is, 2×(f(R1)−Δv)) at the respective representative horizontal position. For example, the voltage correction amount "519 mV", that corresponds to the average, namely, "4.75", of the gray-scale value correction amount candidates set for the representative horizontal positions "0" in the respective look-up tables P, is a value close to the ideal voltage correction amount "526 mV" (see FIG. 6) at the horizontal position "0".

Similar to the look-up table P, the look-up table N is a table for correlating each of the above described five representative horizontal position to a gray-scale correction amount candidate. Similar to the look-up table P, the look-up table N as well is stored in advance, and a gray-scale correction amount candidate set in each look-up table N is determined in consideration of the above described ideal voltage correction amount. Note that, however, the content stored in the look-up table N differs from that in the look-up table P.

In the vertical line correction circuit 8, one negative polarity intermediate gray-scale look-up table (not shown) and one positive polarity intermediate gray-scale look-up table (not shown) are provided. Any intermediate gray-scale look-up table is formed as a table for correlating each of the above described five representative horizontal positions to a gray-scale correction amount candidate. The gray-scale correction amount candidate set in each intermediate gray-scale look-up table is determined in consideration of the ideal voltage correction amount (that is, f(R1)−Δv) at the respective representative horizontal position.

The polarity counter 12*f* outputs a polarity signal indicating the polarity of each pixel to the correction circuit 12*a*, the switch 12*d*, and the data line driving circuit 4 according to a synchronizing signal.

The switch 12*d* outputs the data output from the addition circuit 12*b* to the data line driving circuit 4 when the polarity indicated by the polarity signal is positive, and outputs the data output from the subtraction circuit 12*c* to the data line driving circuit 4 when the polarity indicated by the polarity signal is negative.

Below, operations of the correction circuit 12*a*, the addition circuit 12*b*, and the subtraction circuit 12*c* to be carried out in response to a gray-scale value input to the vertical line correction circuit 8 will be described. In particular, a case in which a gray-scale value of the pixel X is input to the vertical line correction circuit 8 will be described as an example.

[First Case]

Initially, operations of the correction circuit 12*a*, the addition circuit 12*b*, and the subtraction circuit 12*c* to be carried out when the gray-scale value "D" of the pixel X is an intermediate gray-scale value (hereinafter referred to as first case) will be described.

In the first case, the correction circuit 12*a* and the addition circuit 12*b* correct the gray-scale value "D", based on two gray-scale correction amount candidates shown in the positive polarity intermediate gray-scale look-up table, to thereby produce a corrected gray-scale value "D+Δd".

That is, the positive polarity side correction circuit determines a gray-scale correction amount "Δd", based on two gray-scale correction amount candidates shown in the positive polarity intermediate gray-scale look-up table. For example, when the horizontal position of the pixel X is any of "0", "120", "240", "360", and "480", the gray-scale correction amount candidate correlated to the horizontal position of the pixel X is determined as the gray-scale correction amount "Δd". Meanwhile, for example, when the horizontal position of the pixel X is not any of the "0", "120", "240", "360", and "480", an interpolation operation is carried out based on the horizontal position of the pixel X, the representative horizontal position closest to the pixel X among the representative horizontal positions to the right of the pixel X, the representative horizontal position closest to the pixel X among the representative horizontal positions to the left of the pixel X, and gray-scale correction amount candidates correlated to these two representative horizontal positions, to thereby determine the gray-scale correction amount "Δd".

Thereafter, the addition circuit 12*b* adds the gray-scale correction amount "Δd" to the gray-scale value "D", to thereby produce the corrected gray-scale value "D+Δd".

In addition, in the first case, the correction circuit 12*a* and the subtraction circuit 12*c* correct the gray-scale value "D", based on two gray-scale correction amount candidates shown in the negative polarity intermediate gray-scale look-up table, to thereby produce a corrected gray-scale value "D−Δd".

That is, similar to the case using the positive polarity intermediate gray-scale look-up table, the negative polarity side correction circuit determines the gray-scale correction amount "Δd", based on two gray-scale correction amount candidates shown in the negative polarity intermediate gray-scale look-up table.

Thereafter, the subtraction circuit 12*c* subtracts the gray-scale correction amount "Δd" from the gray-scale value "D", to thereby produce the corrected gray-scale value "D−Δd".

Consequently, in the first case, when the polarity of the pixel X indicated by the polarity signal is positive, the corrected gray-scale value "D+Δd" is output from the switch 12*d*, and input via the timing control circuit 10 into the data line driving circuit 4. Meanwhile, when the polarity of the pixel X indicated by the polarity signal is negative, the corrected gray-scale value "D−Δd" is output from the switch 12*d*, and input via the timing control circuit 10 into the data line driving circuit 4.

Therefore, the data line driving circuit 4 outputs the positive polarity gray-scale voltage corresponding to the corrected gray-scale value "D+Δd" as a video signal of the pixel X when the polarity of the pixel X indicated by the polarity signal is positive, and the negative polarity gray-scale voltage corresponding to the corrected gray-scale value "D−Δd" as a video signal of the pixel X when the polarity of the pixel X indicated by the polarity signal is negative.

[Second Case]

Below, operations of the correction circuit 12*a*, the addition circuit 12*b*, and the subtraction circuit 12*c* to be carried out when the gray-scale value "D" of the pixel X is the minimum gray-scale value "0" (hereinafter referred to as the second case) will be described.

In the second case, the correction circuit 12*a* and the addition circuit 12*b* correct the gray-scale value "D", based on two gray-scale correction amount candidates shown in a reference look-up table PX that is any of the eight look-up tables P, to thereby produce the corrected gray-scale value "D+Δd".

That is, while switching the reference look-up table PX in the order of the look-up tables P1 to P8 at the above described switching time interval based on a signal from the timer 12*e*, the positive polarity side correction circuit determines the gray-scale correction amount "ΔD", based on two gray-scale correction amount candidates shown in the reference look-up table PX. For example, when the horizontal position of the pixel X is any of "0", "120", "240", "360", and "480", the gray-scale correction amount candidate correlated to the horizontal position of the pixel X is determined as the gray-scale correction amount "ΔD". Meanwhile, for example, when the horizontal position of the pixel X is not any of the "0", "120", "240", "360", and "480", an interpolation operation is carried out based on the horizontal position of the pixel X, the representative horizontal position closest to the pixel X among the representative horizontal positions to the right of the pixel X, the representative horizontal position closest to the pixel X among the representative horizontal positions to the left of the pixel X, and gray-scale correction amount candidates correlated to these two representative horizontal positions, to thereby determine the gray-scale correction amount "ΔD".

Thereafter, the addition circuit 12*b* adds the gray-scale correction amount "ΔD" to the gray-scale value "D", to thereby produce the corrected gray-scale value "D+ΔD".

In the second case, the correction circuit 12*a* and the subtraction circuit 12*c* do not correct the gray-scale value "D".

Consequently, in the second case, when the polarity of the pixel X indicated by the polarity signal is positive, the corrected gray-scale value "D+ΔD", that is, the corrected gray-scale value "ΔD", is output from the switch 12*d*, while, when the polarity of the pixel X indicated by the polarity signal is negative, the gray-scale value "D", that is, the gray-scale value "0" itself, is output from the switch 12*d*.

Therefore, the data line driving circuit 4 outputs the positive polarity gray-scale voltage "$V_0$+ΔVx" corresponding to the corrected gray-scale value "D+ΔD" as a video signal of the pixel X when the polarity of the pixel X indicated by the polarity signal is positive, and outputs the negative polarity gray-scale voltage "$V_0$" corresponding to the gray-scale value "D" itself as a video signal of the pixel X when the polarity of the pixel X indicated by the polarity signal is negative.

[Third Case]

Below, operations of the correction circuit 12*a*, the addition circuit 12*b*, and the subtraction circuit 12*c* to be carried out when the gray-scale value "D" of the pixel X is the maximum gray-scale value "Dmax" (hereinafter referred to as the third case) will be described.

In the third case, differing from the second case, the correction circuit 12*a* and the addition circuit 12*b* do not correct the gray-scale value "D".

However, in the third case, the correction circuit 12*a* and the subtraction circuit 12*c* correct the gray-scale value "D", based on two gray-scale correction amount candidates shown in a reference look-up table NX that is any of the eight look-up tables N, to thereby produce the corrected gray-scale value "D−ΔD".

That is, while switching the reference look-up table NX in the order of the look-up tables N1 to N8 at the above described switching time interval based on a signal from the timer 12*e*, the negative polarity side correction circuit determines the gray-scale correction amount "ΔD", based on two gray-scale correction amount candidates shown in the reference look-up table NX. For example, when the horizontal position of the pixel X is any of "0", "120", "240", "360", and "480", the gray-scale correction amount candidate correlated to the horizontal position of the pixel X is determined as the gray-scale correction amount "ΔD". Meanwhile, for example, when the horizontal position of the pixel X is not any of the "0", "120", "240", "360", and "480", an interpolation operation is carried out based on the horizontal position of the pixel X, the representative horizontal position closest to the pixel X among the representative horizontal positions to the right of the pixel X, the representative horizontal position closest to the pixel X among the representative horizontal positions to the left of the pixel X, and gray-scale correction amount candidates correlated to these two representative horizontal positions, to thereby determine the gray-scale correction amount "ΔD".

Thereafter, the subtraction circuit 12*c* subtracts the gray-scale correction amount "ΔD" from the gray-scale value "D", to thereby produce the corrected gray-scale value "D−ΔD".

Consequently, in the third case, when the polarity of the pixel X indicated by the polarity signal is negative, the corrected gray-scale value "D−ΔD", that is, the corrected gray-scale value "Dmax−ΔD", is output from the switch 12*d*, while, when the polarity of the pixel X indicated by the polarity signal is positive, the gray-scale value "D", that is, the gray-scale value "Dmax" itself, is output from the switch 12*d*.

Therefore, the data line driving circuit 6 outputs the negative polarity gray-scale voltage "$V_m$+ΔVx" corresponding to the corrected gray-scale value "D−ΔD" as a video signal of the pixel X when the polarity of the pixel X indicated by the polarity signal is negative, and outputs the positive polarity gray-scale voltage "$V_{m+}$" corresponding to the gray-scale value "D" itself as a video signal of the pixel X when the polarity of the pixel X indicated by the polarity signal is positive.

Note that the switching time period is desired to be longer than the polarity inversion cycle of the data line driving circuit 4. In this embodiment, the polarity inversion cycle of the data line driving circuit 4 is twice as long as the frame time.

Here, it seems fine to provide one look-up table P and one look-up table N. That is, it seems fine that one look-up table P for correlating each of all of the horizontal positions in the liquid crystal panel 9 to a gray-scale correction amount candidate is used as the reference look-up table PX in the second case, and that one look-up table N for correlating each of all of the horizontal positions in the liquid crystal panel 9 to a gray-scale correction amount candidate is used as the reference look-up table NX in the third case.

In such a case, however, as a gray-scale correction amount candidate is stored with respect to all of the horizontal positions, an increased data amount is resulted. Regarding this point, in the liquid crystal display device 2, the data amount can be reduced compared to the above described case in which the above described one look-up table P and the above described one look-up table N are used.

Figures 10, 11:
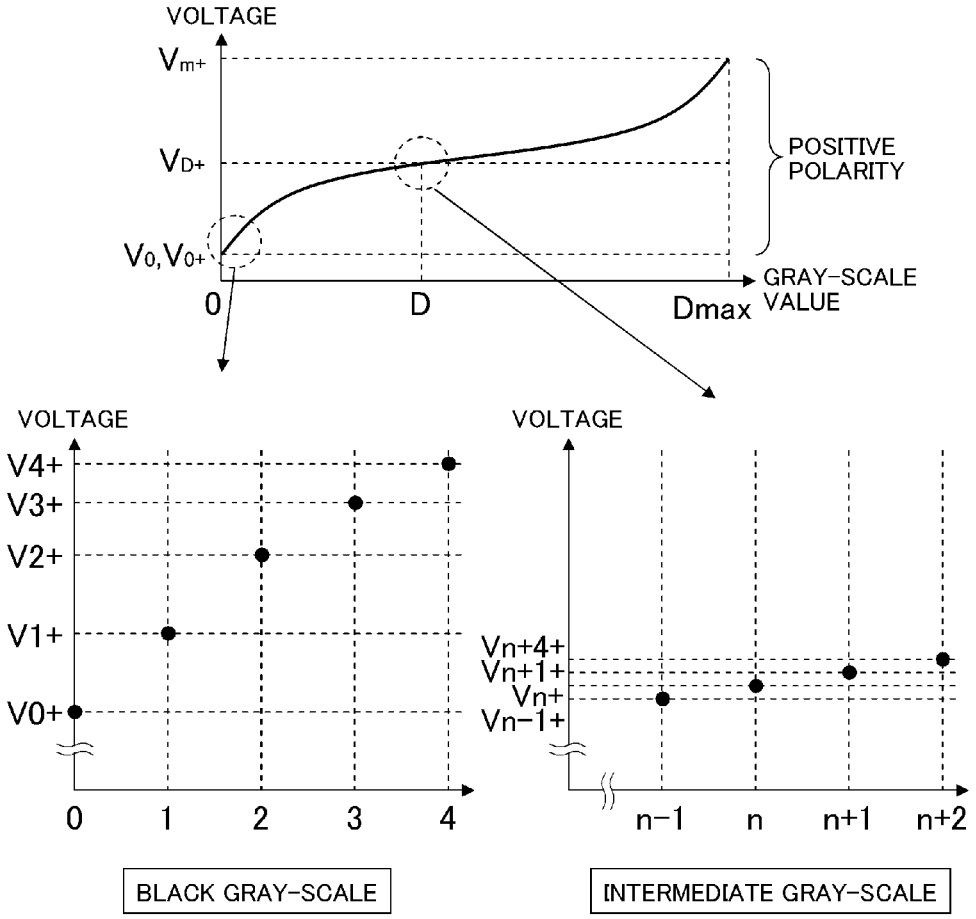
FIG. 10 is a diagram explaining an operation of the vertical line correction circuit.
FIG. 11 is a diagram explaining an operation of the vertical line correction circuit.
Figure 12:
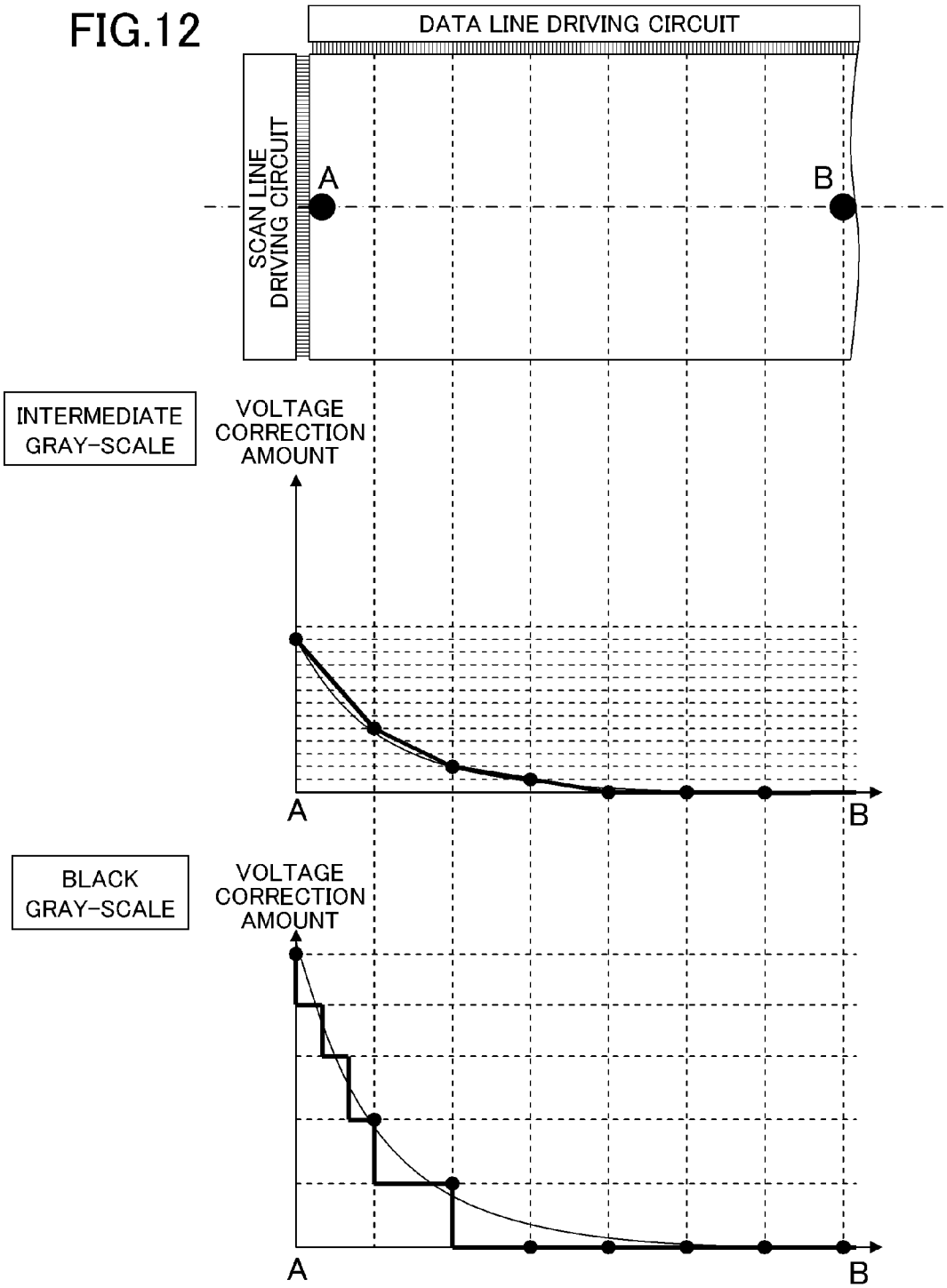
FIG. 12 is a diagram explaining an operation of the vertical line correction circuit.

Further, it seems fine in the second case that the gray-scale correction amount ΔD is determined through an interpolation operation, similar to the first case, using only the look-up table P shown in FIG. 10 as the reference look-up table PX. Still further, it seems fine in the third case that the gray-scale correction amount ΔD is determined through an interpolation operation, similar to the first case, using only one look-up table N (e.g., the look-up table N1) as the reference look-up table NX.

In such a case, however, there is a problem that it is difficult to have the voltage correction amount ΔVx be close to the ideal voltage correction amount. This will be described below.

As described above, Δd and ΔD are determined through an interpolation operation. Therefore, Δd and ΔD linearly changes according to the horizontal position of the pixel X. That is, when the gray-scale voltage changes largely with respect to the unit change amount of Δd (that is, "1"), the gray-scale voltage changes largely with respect to the unit change amount (that is "1") of the horizontal position of the pixel X, while when the gray-scale voltage changes small with respect to the unit change amount of Δd, the gray-scale voltage changes small with respect to the unit change amount of the horizontal position of the pixel X. Further, when the gray-scale voltage changes largely with respect to the unit change amount of ΔD, the gray-scale voltage changes largely with respect to the unit change amount of the horizontal position of the pixel X, while when the gray-scale voltage changes small with respect to the unit change amount of ΔD, the gray-scale voltage changes small with respect to the unit change amount of the horizontal position of the pixel X.

Regarding this point, as shown lower right in FIG. 11, around the intermediate gray-scale value, the gray-scale voltage changes relatively small with respect to the unit change amount of the gray-scale value. Therefore, the gray-scale voltage changes relatively small with respect to the unit change amount of the horizontal position of the pixel X. Accordingly, as shown in the middle diagram in FIG. 12, the voltage correction amount corresponding to Δd can readily become a value close to the ideal voltage correction amount at any horizontal position. Note that the zigzag line in the middle graph in FIG. 12 indicates the voltage correction amount corresponding to Δd, and the curved line indicates the ideal voltage correction amount.

Meanwhile, as shown lower left in FIG. 11, around the black gray-scale, the gray-scale voltage changes largely with respect to the unit change amount of the gray-scale value. Therefore, the gray-scale voltage changes largely with respect to the unit change amount of the horizontal position of the pixel X. Accordingly, as shown in the bottom graph in FIG. 12, the voltage correction amount corresponding to ΔD becomes a value far from the ideal voltage correction amount, depending on a position. This is true with the white gray-scale. Note that the zigzag line in the bottom graph of FIG. 12 indicates the voltage correction amount corresponding to ΔD, and the curved line indicates the ideal voltage correction amount.

Therefore, around the black or white gray-scale, it is difficult to have the voltage correction amount ΔVx close to the ideal voltage correction amount, depending on the position of the pixel X.

Figure 13:
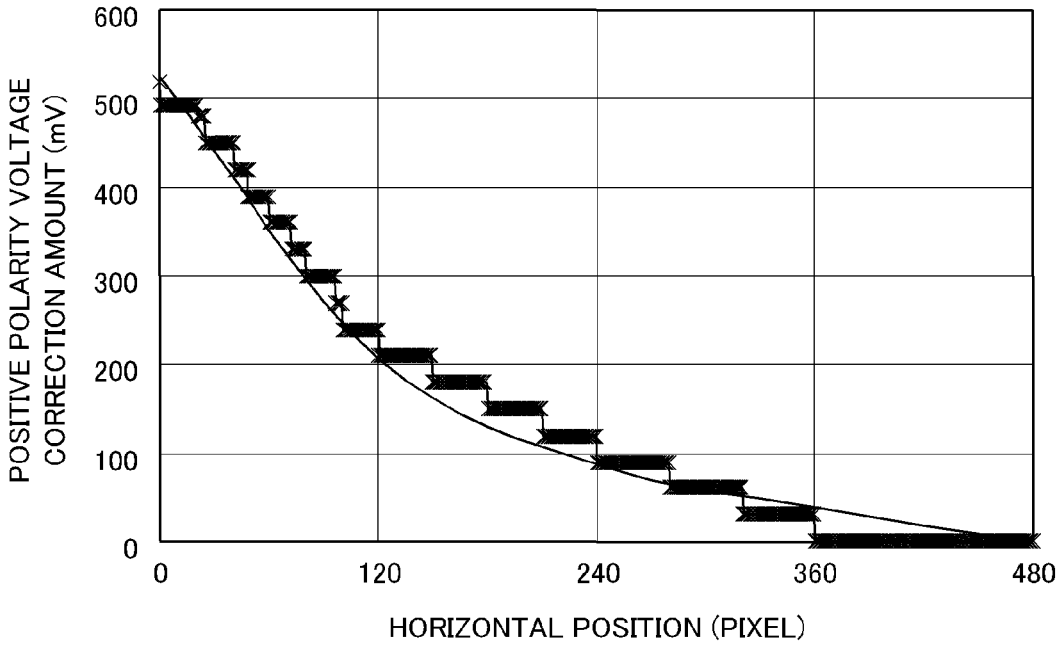
FIG. 13 is a diagram explaining an operation of the vertical line correction circuit.

Regarding this point, in the liquid crystal display device 2, however, as the reference look-up tables P and N are respectively switchable, it is possible to have the average of the voltage correction amounts ΔVx be close to the ideal voltage correction amount, that is, the curved line shown in FIG. 13, at any horizontal position, as shown in FIG. 13. Consequently, it is possible to prevent with high accuracy generation of an afterimage.

It should be noted that an embodiment of the present invention is not limited to the above described embodiments.

That is, for example, although a video signal of the pixel X is corrected by correcting the gray-scale value "D" of the pixel X in the above described embodiment, a voltage may be added or subtracted with respect to a video signal of the pixel X to thereby correct the video signal of the pixel X.

Further, the liquid crystal display device 2 may have either one of the scan line driving circuit 6*a* and the scan line driving circuit 6*b*.

First Modified Example

When the refresh rate is high, such as when the refresh rate is, e.g., 240 Hz, a shorter horizontal period is resulted. Therefore, there may be a case in which the pixel X is not charged with an expected amount of charge during one horizontal period. Consequently, there is caused a problem that the voltage of the pixel X cannot increase or decrease to a value expected during one horizontal period, and accordingly, image quality is deteriorated.

To address the above, a technique referred to as pre-charging may be employed. That is, when outputting a positive polarity video signal of the pixel X, the data line driving circuit 4 may output a video signal during the second half of one horizontal period and a corrected video signal at a voltage higher or lower than the video signal during the first half of the horizontal period. That is, the data line driving circuit 4 may output a positive polarity gray-scale voltage corresponding to a gray-scale value "X" output from the vertical line correction circuit 8 during the second half period and a signal at a voltage either higher or lower than the gray-scale voltage during the first half period. Note that a gray-scale value "X" refers to a gray-scale value that is output from the vertical line correction circuit 8 upon input of the gray-scale value "D" of the pixel X.

Meanwhile, when outputting a negative polarity video signal of the pixel X, the data line driving circuit 4 may output a video signal during the second half period and a corrected video signal at a voltage either lower or higher than the video signal during the first half period. That is, the data line driving circuit 4 may output a negative polarity gray-scale voltage corresponding to a gray-scale value "X" output from the vertical line correction circuit 8 during the second half period and a signal at a voltage either lower or higher than the gray-scale voltage during the first half period.

Below, the first modified embodiment will be described referring to FIGS. 14 and 15 for explaining this aspect (first modified example).

Figure 14:
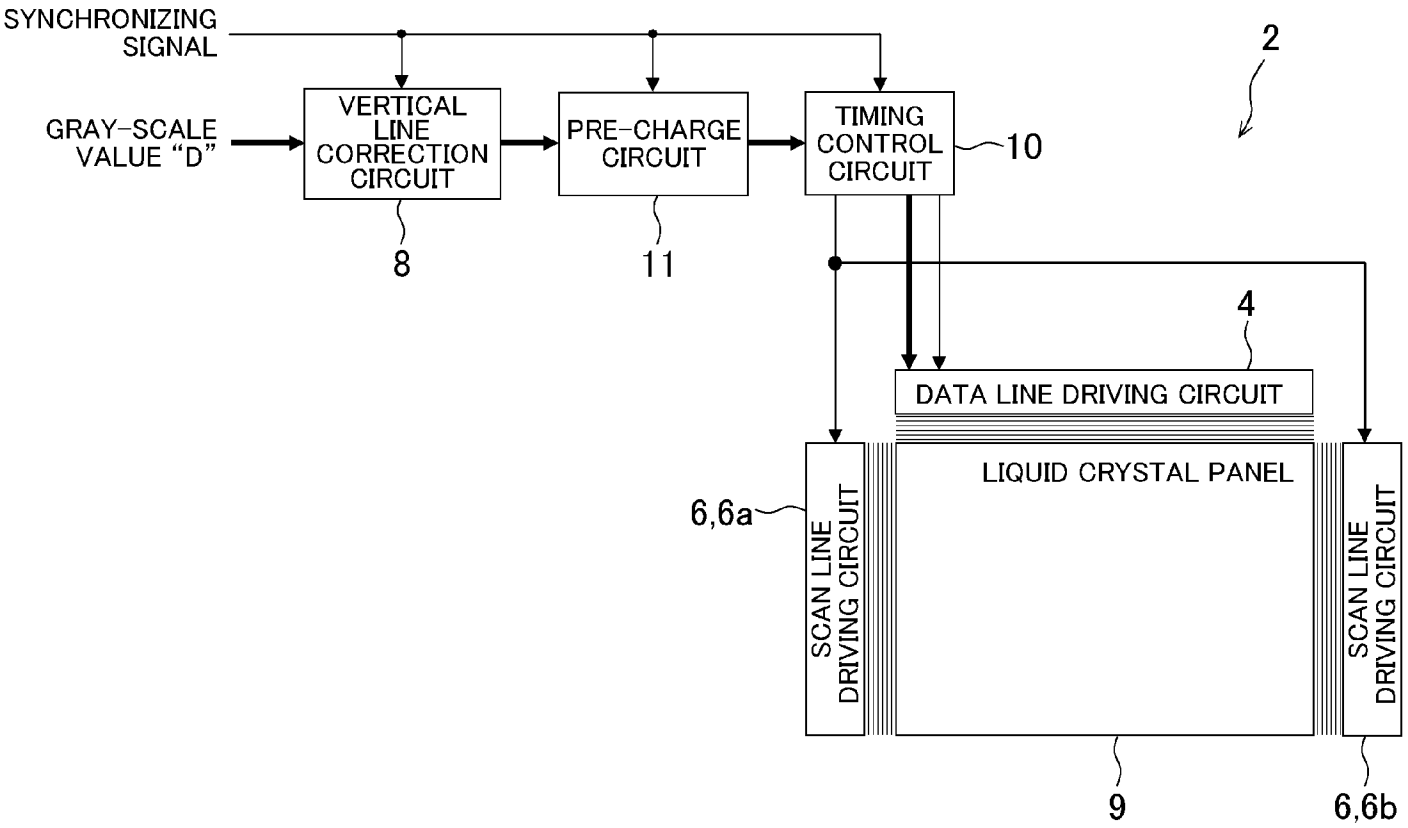
FIG. 14 is a diagram explaining a first modified example.
Figure 15:
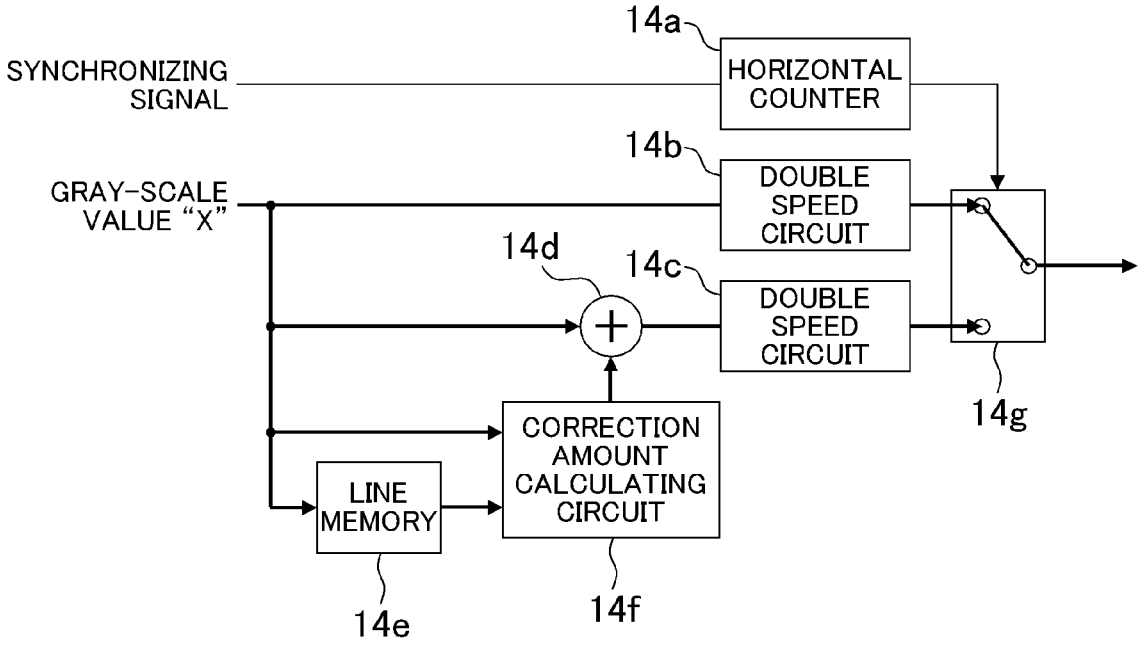
FIG. 15 is a diagram explaining the first modified example.

FIG. 14 is a diagram showing a structure of the liquid crystal display device 2 according to the first modified example. As shown in the diagram, in the first modified example, a pre-charge circuit 11 is additionally included for causing the data line driving circuit 4 to operate as described above. FIG. 15 shows a structure of the pre-charge circuit 11.

An operation of the pre-charge circuit 11 to be carried out upon input of a gray-scale value "X" will be described. Note that, when the gray-scale value "D" of the pixel X is the intermediate gray-scale value, the gray-scale value "X" becomes either "D+Δd" or "D−Δd"; when the gray-scale value "D" of the pixel X is the minimum gray-scale value "0", the gray-scale value "X" becomes either "ΔD" or "0"; when the gray-scale value "D" of the pixel X is the maximum gray-scale value "Dmax", the gray-scale value "X" becomes either "Dmax" or "Dmax−ΔD".

The correction amount calculating circuit 14*f* calculates a pre-charging amount ΔX, based on the gray-scale value "Y" of a pixel Y which is upper in position by one than the pixel X, the gray-scale value "Y" being stored in the line memory 14*e*, and the gray-scale value "X". For example, the correction amount calculating circuit 14*f* compares the gray-scale value "Y" and the gray-scale value "X" to calculate a pre-charging amount ΔX according to the difference between the gray-scale value "Y" and the gray-scale value "X".

Then, the addition circuit 14*d* produces a pre-charging gray-scale value "X+ΔX" or "X−ΔX", based on the pre-charging amount ΔX. That is, a pre-charging gray-scale value "X+ΔX" is produced when the gray-scale value "X" is equal to or larger than the gray-scale value "Y", while a pre-charging gray-scale value "X−ΔX" is produced when the gray-scale value "X" is smaller than the gray-scale value "Y".

This pre-charging gray-scale value is input to a double speed circuit 14*c*. The double speed circuit 14*c* carries out a double speed process to output the pre-charging gray-scale value to the switch 14*g*.

Meanwhile, to a double speed circuit 14*b*, the gray-scale value "X" itself, not the pre-charging gray-scale value, is input. The double speed circuit 14*b* carries out the double speed process to output the gray-scale value "X" to the switch 14*g*.

The switch 14*g* connects to either the double speed circuit 14*b* or the double speed circuit 14*c*.

Specifically, upon input of a predetermined signal from the horizontal counter 14*a*, the switch 14*g* switches members to connect at an interval of a half horizontal period, which is a half of one horizontal period, according to the signal. Consequently, during the first half period, the pre-charging gray-scale value is output from the switch 14*g* and input via the timing control circuit 10 to the data line driving circuit 4, while during the second half period, the gray-scale value "X" itself is output from the switch 14*g* and input via the timing control circuit 10 to the data line driving circuit 4.

As a result, when the polarity of the pixel X indicated by the polarity signal is positive, a positive polarity gray-scale voltage corresponding to the pre-charging gray-scale value "X+ΔX" or "X−ΔX" is output as the corrected video signal from the data line driving circuit 4 during the first half period, and a positive polarity gray-scale voltage corresponding to the gray-scale value "X" is output as a video signal from the data line driving circuit 4 during the second half period. Meanwhile, when the polarity of the pixel X indicated by the polarity signal is negative, a negative polarity gray-scale voltage corresponding to the pre-charging gray-scale value "X+ΔX" or "X−ΔX" is output as the corrected video signal from the data line driving circuit 4 during the first half period, and a negative polarity gray-scale voltage corresponding to the gray-scale value "X" is output as a video signal from the data line driving circuit 4 during the second half period.

Note that, as a method for compensating for shortage of the charged amount, there may be available a method in which two data line driving circuits 4 are provided to output a scan signal to each of two upper and lower scan lines GL for every output of the scan signal. This, however, increases the number of data lines DL, which decreases the aperture ratio and display brightness. Further, increase of the number of data line driving circuit 4 leads to increase of the manufacturing costs.

Regarding this point, the first modified example can better solve the problem of shortage of the charge amount charged to a pixel, while reducing the manufacturing costs and decrease of display brightness, compared to the above described method.

Note that the liquid crystal display device 2 is a product resulted during the process of developing a liquid crystal device that carries out pre-charging. Below, the process of development will be described referring to FIGS. 16 and 17.

Initially, reduction of power consumption was considered. In general, as a driving method for the data line driving circuit 4, there are available a driving method in which the polarity of a video signal is inverted at a frame time interval, and a driving method in which the polarity of a video signal is inverted at a horizontal period interval. Of these two, the former driving method consumes fewer power than the latter driving method as the polarity inversion cycle of the data line driving circuit 4 according to the former driving method is longer than that of the latter driving method. Therefore, the former driving method was employed.

Figure 16:
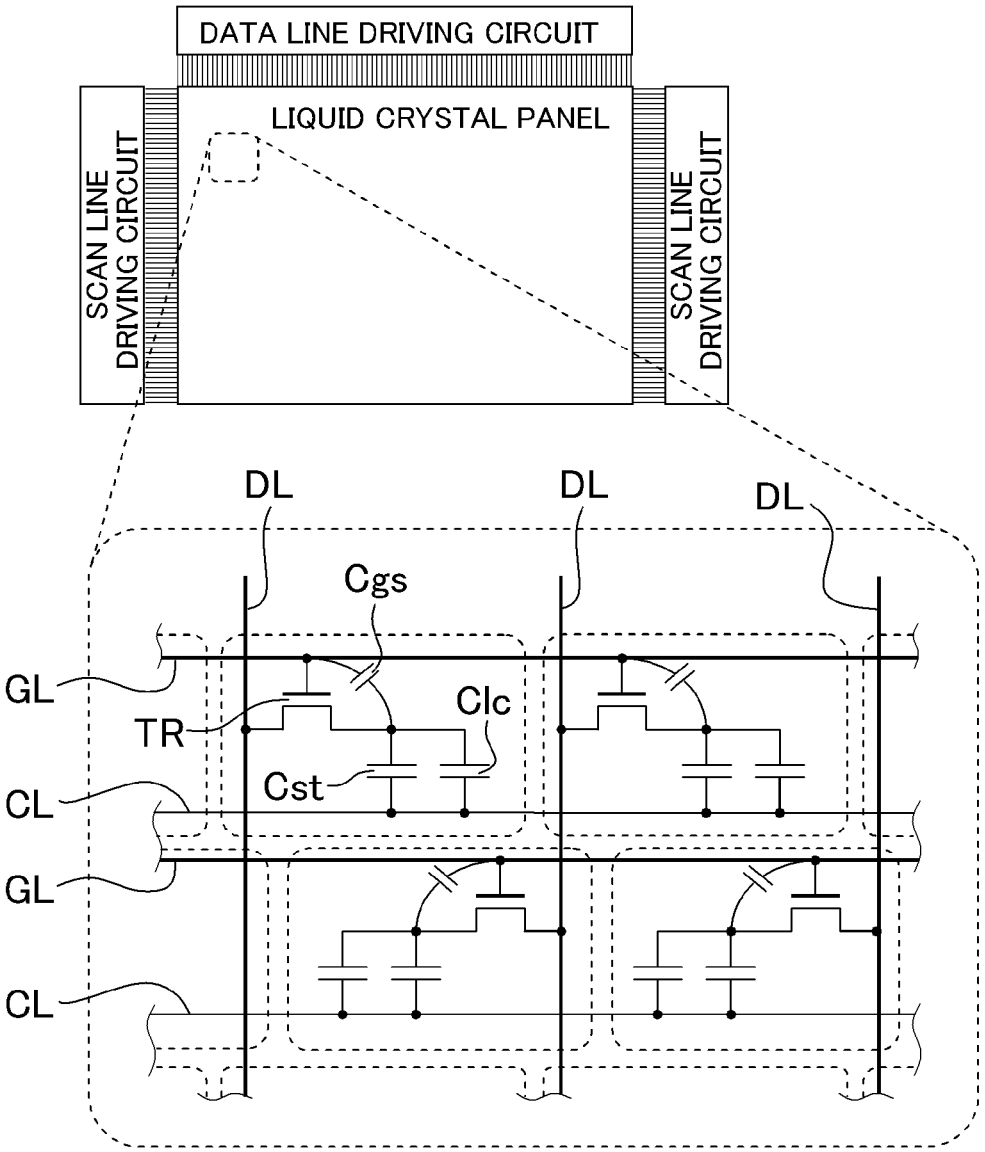
FIG. 16 is a diagram explaining the process of development.

Next, a pixel arrangement method was considered. In general, as a pixel arrangement method, a stripe arrangement and a so-called staggered arrangement, such as is shown in FIG. 16, are available. When the stripe arrangement is employed, column inversion driving is employed, and when staggered arrangement is employed, dot inversion driving is employed.

As the pre-charging amount ΔX is determined according to the difference between the gray-scale value of a pixel and that of a pixel upper in position by one than the pixel, as described above, it is desired for accurate determination of the pre-charging amount ΔX, that the color planes of the upper and lower pixels are the same because correlation in the gray-scale value between the upper and lower pixels is strong. In this view, the stripe arrangement with the color planes of the upper and lower pixels being the same was employed, rather than the staggered arrangement with the color planes of the upper and lower pixels being different.

In an experiment using the stripe arrangement, the phenomenon described below was caused. The inventors call this phenomenon as "vertical line move". Below, the vertical line move will be described referring to FIG. 17A to FIG. 17C.

Figure 17A:
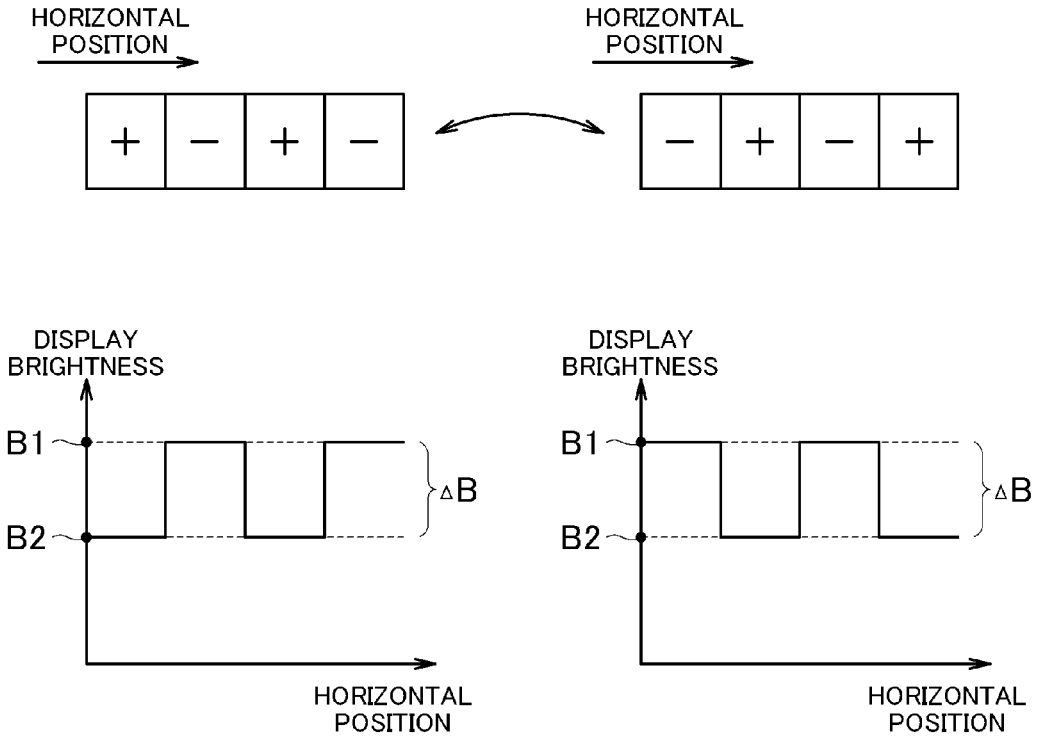
FIG. 17A is a diagram explaining the process of development.

FIG. 17A is a diagram showing distribution of the voltage polarities of the respective pixels included in a pixel array in the horizontal direction, which can be realized with the column inversion driving. As shown in the diagram, according to the column inversion driving, the distribution shown upper left and that shown upper right in FIG. 17A are alternately realized. For brevity, a case of pixels having the same pixel value is assumed.

Below, a pixel with "+" is referred to as a positive polarity pixel and a pixel with "−" is referred to as a negative polarity pixel in the following description.

When the symmetric property between the positive polarity voltage and negative polarity voltage of a pixel electrode relative to the common voltage Vc is destroyed due to a field through phenomenon, each pixel is charged with a DC charge. FIG. 17A shows an example in which the display brightness B1 of a negative polarity pixel becomes higher than that of a positive polarity pixel due to a field through phenomenon. The distribution shown upper left in FIG. 17A results in distribution of display brightness shown lower left in the diagram, while the distribution shown upper right results in distribution of display brightness shown lower right. Note that ΔB indicates the difference between B1 and B2.

Figure 17B:
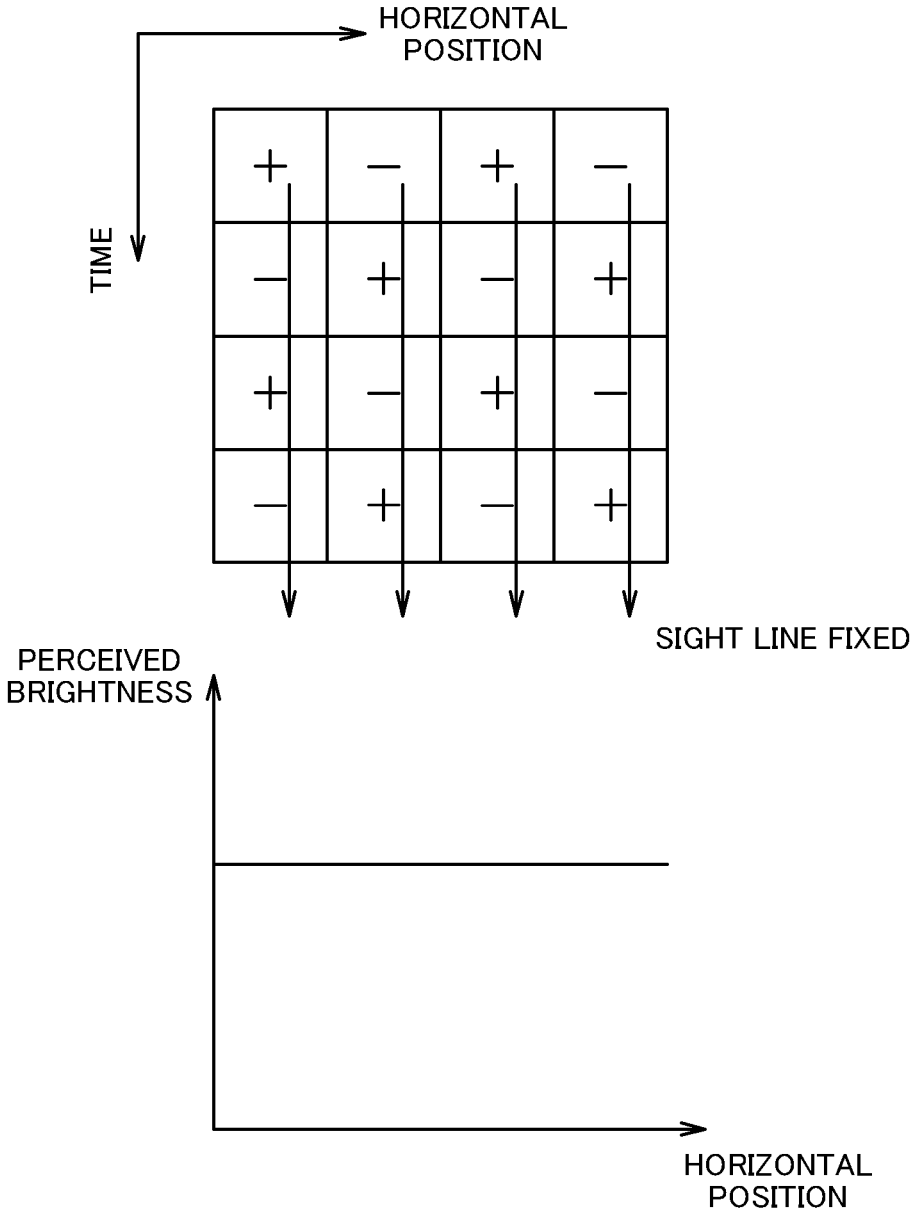
FIG. 17B is a diagram explaining the process of development.

When a user's sight line is fixed, as the display brightness of each pixel alternately changes between B1 and B2, as shown in FIG. 17B, the brightness perceived by the user appears uniform among the respective pixels. Therefore, there is seemingly no problem.

Figure 17C:
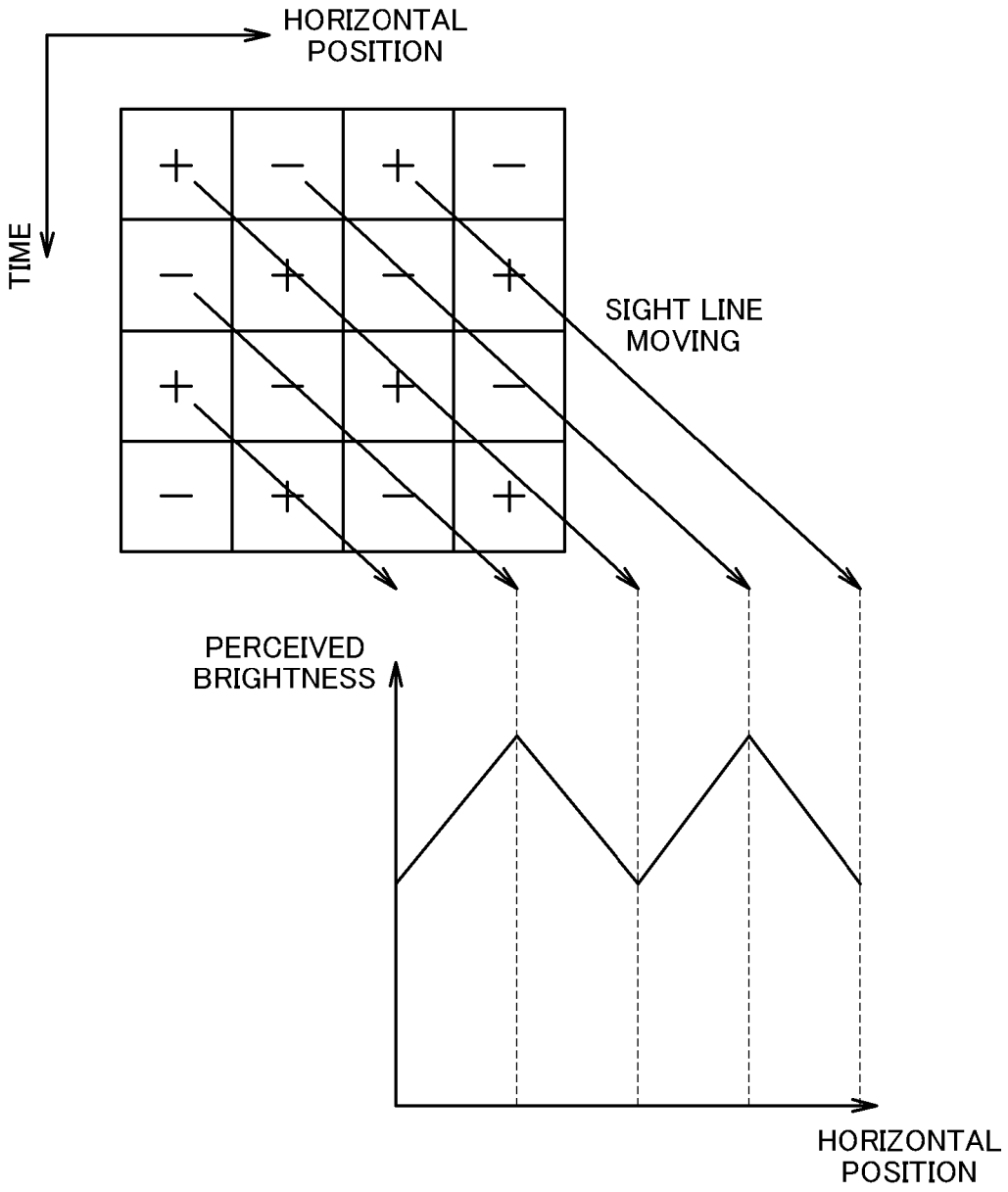
FIG. 17C is a diagram explaining the process of development.

However, when a user's sight line moves (e.g., a motion image is shown), the difference in display brightness may be perceived, as shown in FIG. 17C, depending on the moving speed of the sight line. Therefore, it is understood that a phenomenon, that is, vertical line move, in which a vertical line comprising a relatively dark vertical line and a relatively bright vertical line moves in the moving direction of the sight line occurs.

To address the above, the inventors adapted measures of correcting a video signal of a pixel having an intermediate gray-scale value in the manner described above. However, it was understood that, despite the measures, a pixel was still charged with a slight amount of DC charge, and that the measures were turned out to be insufficient to make the vertical line move insignificant. To address the above, in order to further reduce the amount of DC current charged to a pixel, there was a need of correcting the video signal of a pixel having the minimum gray-scale value and that having the maximum gray-scale value as well. This need has led to invention of the liquid crystal display device 2.

Second Modified Example

In the above-described embodiment, as the gray-scale value of a pixel X that is a value (e.g., "1") close to the minimum gray-scale value "0" is still considered as the intermediate gray-scale value, the voltage correction amount (that is, ΔV−Δv) for the pixel X is significantly different from the voltage correction amount ΔVx (≈2×(ΔV−Δv)) for the pixel X having the minimum gray-scale value "0". This is true with a pixel X having a gray-scale value (e.g., "Dmax−1") close to the maximum gray-scale value "Dmax". Therefore, in the above described embodiment, the voltage correction amount sharply changes in the vicinity of the minimum gray-scale value "0" and the maximum gray-scale value "Dmax", which possibly causes an afterimage.

Figure 18A:
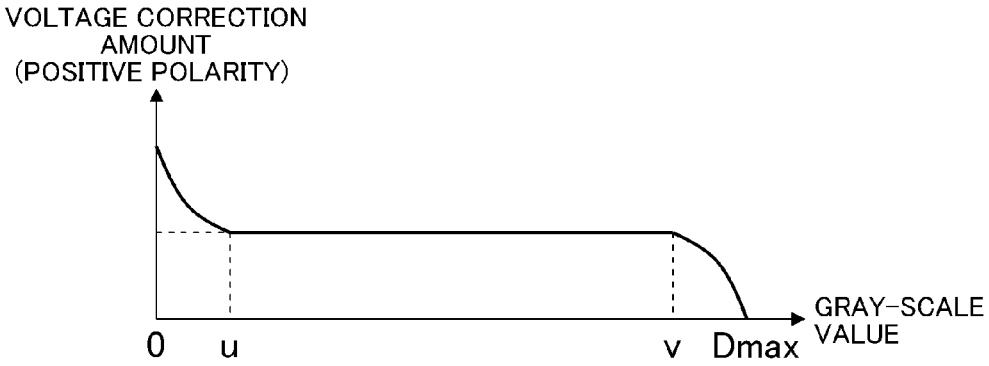
FIG. 18A is a diagram explaining a second modified example.

To address the above, in order to smoothen the change of the voltage correction amount in the vicinity of the minimum gray-scale value "0" and the maximum gray-scale value "Dmax", when the data line driving circuit 4 outputs a positive polarity video signal in the case where the gray-scale value "D" of the pixel X is an intermediate gray-scale value belonging to a first gray-scale value range including the gray-scale values "D" between "1" and "u" inclusive (hereinafter referred to as a first intermediate gray-scale value), the voltage correction amount may be changed according to the gray-scale value "D" in the manner shown in FIG. 18A.

Figure 18B:
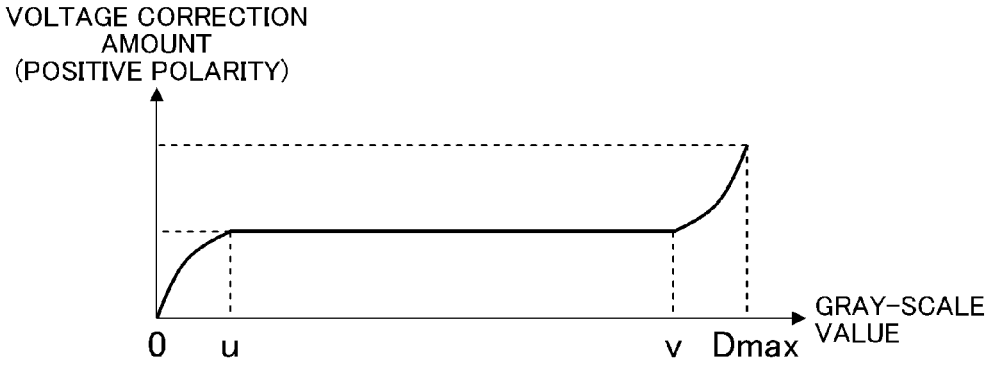
FIG. 18B is a diagram explaining the second modified example.

Meanwhile, when the data line driving circuit 4 outputs a negative polarity video signal in the case where the gray-scale value "D" of the pixel X is an intermediate gray-scale value belonging to a second gray-scale value range including the gray-scale values "D" between "v(v>u)" and "Dmax−1" inclusive (hereinafter referred to as a second intermediate gray-scale value), the voltage correction amount may be changed according to the gray-scale value "D" in the manner shown in FIG. 18B. Below, this aspect (the second modified example) will be described.

Initially, operations of the correction circuit 12*a*, the addition circuit 12*b*, and the subtraction circuit 12*c* to be carried out when the gray-scale value "D" of the pixel X is an intermediate gray-scale value other than the first intermediate gray-scale value and the second intermediate gray-scale value (hereinafter referred to as the fourth case) will be described. In the fourth case, the correction circuit 12*a*, the addition circuit 12*b*, and the subtraction circuit 12*c* operate similar to the first case.

Below, operations of the correction circuit 12*a*, the addition circuit 12*b*, and the subtraction circuit 12*c* to be carried out when the gray-scale value "D" of the pixel X is the first intermediate gray-scale value (the fifth case) will be described.

In the fifth case, similar to the first case, the correction circuit 12*a* and the subtraction circuit 12*c* correct the gray-scale value "D", based on two gray-scale correction amount candidates shown in the negative polarity intermediate gray-scale look-up table, to thereby produce the corrected gray-scale value "D−Δd".

Meanwhile, in the fifth case, the correction circuit 12*a* and the addition circuit 12*b* use not only the positive polarity intermediate gray-scale look-up table but also the reference look-up table PX in correcting the gray-scale value "D" to thereby produce the corrected gray-scale value "D+Δd".

That is, the positive correction circuit determines a first gray-scale correction amount candidate, based on two gray-scale correction amount candidates shown in the positive polarity intermediate gray-scale look-up table. For example, when the horizontal position of the pixel X is any of "0", "120", "240", "360", and "480", a gray-scale correction amount candidate corresponding to the horizontal position of the pixel X is determined as the first gray-scale correction amount candidate. Meanwhile, for example, when the horizontal position of the pixel X is not any of the "0", "120", "240", "360", and "480", an interpolation operation is carried out based on the horizontal position of the pixel X, the representative horizontal position closest to the pixel X among the representative horizontal positions to the right of the pixel X, the representative horizontal position closest to the pixel X among the representative horizontal positions to the left of the pixel X, and gray-scale correction amount candidates correlated to these two representative horizontal positions, to thereby determine the first gray-scale correction amount candidate.

In addition, the positive correction circuit determines a second gray-scale correction amount candidate, based on two gray-scale correction amount candidates shown in the reference look-up table PX. For example, when the horizontal position of the pixel X is any of "0", "120", "240", "360", and "480", the gray-scale correction amount candidate corresponding to the horizontal position of the pixel X is determined as the second gray-scale correction amount candidate. Meanwhile, for example, when the horizontal position of the pixel X is not any of the "0", "120", "240", "360", and "480", an interpolation operation is carried out based on the horizontal position of the pixel X, the representative horizontal position closest to the pixel X among the representative horizontal positions to the right of the pixel X, the representative horizontal position closest to the pixel X among the representative horizontal positions to the left of the pixel X, and gray-scale correction amount candidates correlated to these two representative horizontal positions, to thereby determine the second gray-scale correction amount candidate.

Then, the positive polarity side correction circuit carries out an interpolation operation based on the intermediate gray-scale value "u+1", the minimum gray-scale value "0", the first gray-scale correction amount candidate corresponding to the intermediate gray-scale value "u+1", the second gray-scale correction amount candidate corresponding to the minimum gray-scale value "0", and the gray-scale value "D" of the pixel X that is the first intermediate gray-scale value, to thereby determine the gray-scale correction amount "Δd".

Thereafter, the addition circuit 12*b* adds the gray-scale correction amount "Δd" to the gray-scale value "D" to thereby produce the corrected gray-scale value "D+Δd".

Below, operations of the correction circuit 12*a*, the addition circuit 12*b*, and the subtraction circuit 12*c* to be carried out when the gray-scale value "D" of the pixel X is the second intermediate gray-scale value (the sixth case) will be described.

In the sixth case, similar to the second case, the correction circuit 12*a* and the addition circuit 12*b* correct the gray-scale value "D" to thereby produce the corrected gray-scale value "D+Δd".

In the sixth case, however, the correction circuit 12*a* and the subtraction circuit 12*c* use not only the negative polarity intermediate gray-scale look-up table but also the reference look-up table NX in correcting the gray-scale value "D" to thereby produce the corrected gray-scale value "D−Δd".

That is, the negative correction circuit determines a third gray-scale correction amount candidate, based on two gray-scale correction amount candidates shown in the negative polarity intermediate gray-scale look-up table. For example, when the horizontal position of the pixel X is any of "0", "120", "240", "360", and "480", the gray-scale correction amount candidate corresponding to the horizontal position of the pixel X is determined as the third gray-scale correction amount candidate. Meanwhile, for example, when the horizontal position of the pixel X is not any of the "0", "120", "240", "360", and "480", an interpolation operation is carried out based on the horizontal position of the pixel X, the representative horizontal position closest to the pixel X among the representative horizontal positions to the right of the pixel X, the representative horizontal position closest to the pixel X among the representative horizontal positions to the left of the pixel X, and gray-scale correction amount candidates correlated to these two representative horizontal positions, to thereby determine the third gray-scale correction amount candidate.

In addition, the negative correction circuit determines a fourth gray-scale correction amount candidate, based on two gray-scale correction amount candidates shown in the reference look-up table NX. For example, when the horizontal position of the pixel X is any of "0", "120", "240", "360", and "480", the gray-scale correction amount candidate corresponding to the horizontal position of the pixel X is determined as the fourth gray-scale correction amount candidate. Meanwhile, for example, when the horizontal position of the pixel X is not any of the "0", "120", "240", "360", and "480", an interpolation operation is carried out based on the horizontal position of the pixel X, the representative horizontal position closest to the pixel X among the representative horizontal positions to the right of the pixel X, the representative horizontal position closest to the pixel X among the representative horizontal positions to the left of the pixel X, and gray-scale correction amount candidates correlated to these two representative horizontal positions, to thereby determine the fourth gray-scale correction amount candidate.

Then, the negative polarity side correction circuit carries out an interpolation operation based on the intermediate gray-scale value "v−1", the maximum gray-scale value "Dmax", the third gray-scale correction amount candidate corresponding to the intermediate gray-scale value "v−1", the fourth gray-scale correction amount candidate corresponding to the maximum gray-scale value "Dmax", and the gray-scale value "D" of the pixel X that is the first intermediate gray-scale value, to thereby determine the gray-scale correction amount "Δd".

Thereafter, the subtraction circuit 12*c* subtracts the gray-scale correction amount "Δd" from the gray-scale value "D" to thereby produce the corrected gray-scale value "D−Δd".

While there have been described what are at present considered to be certain embodiments of the invention, it will be understood that various modifications may be made thereto, and it is intended that the appended claims cover all such modifications as fall within the true spirit and scope of the invention.

What is claimed is:

1. A liquid crystal display device, comprising:

a plurality of data lines;

a plurality of scan lines;

a data line driving circuit for selectively outputting a positive polarity video signal or a negative polarity video signal of a pixel corresponding to a data line that is any of the plurality of data lines and a scan line that is any of the plurality of scan lines to the data line for every predetermined output cycle; and a scan line driving circuit for outputting a scan signal to the scan line when the video signal of the pixel is output, wherein the data line driving circuit, in a case where a gray-scale value of the pixel is an intermediate gray-scale value that is a gray-scale value other than a first gray-scale value indicating minimum gray-scale and a second gray-scale value indicating maximum gray-scale, outputs a video signal having a voltage obtained by correcting a positive polarity gray-scale voltage corresponding to the gray-scale value of the pixel when outputting the positive polarity video signal, and outputs a video signal having a voltage obtained by correcting a negative polarity gray-scale voltage corresponding to the gray-scale value of the pixel when outputting the negative polarity video signal, the data line driving circuit, in a case where the gray-scale value of the pixel is the first gray-scale value, outputs a video signal having a voltage obtained by correcting a first positive polarity gray-scale voltage corresponding to the first gray-scale value when outputting the positive polarity video signal, and outputs a video signal having a first negative polarity gray-scale voltage corresponding to the first gray-scale value without correction when outputting the negative polarity video signal, and the data line driving circuit, in a case where the gray-scale value of the pixel is the second gray-scale value, outputs a video signal having a second positive polarity gray-scale voltage corresponding to the second gray-scale value without correction when outputting the positive polarity video signal, and outputs a video signal having a voltage obtained by correcting a second negative polarity gray-scale voltage corresponding to the second gray-scale value when outputting the negative polarity video signal.

2. The liquid crystal display device according to claim 1, wherein the data line driving circuit changes, for every predetermined cycle, a voltage correction amount that is used in outputting the video signal having the voltage obtained by correcting the first positive polarity gray-scale voltage, and wherein the data line driving circuit changes, for every predetermined cycle, the voltage correction amount that is used in outputting the video signal having the voltage obtained by correcting the second negative polarity gray-scale voltage.

3. The liquid crystal display device according to claim 2, further comprising:

a production circuit for producing a corrected gray-scale value when the gray-scale value of the pixel is either the first gray-scale value or the second gray-scale value by correcting the gray-scale value of the pixel, based on a correction amount candidate group including a plurality of correction amount candidates, and an output circuit for selectively outputting either one of the gray-scale value itself of the pixel and the corrected gray-scale value produced by the production circuit when the gray-scale value of the pixel is either the first gray-scale value or the second gray-scale value, wherein when the gray-scale value of the pixel is the first gray-scale value, the data line driving circuit outputs a video signal having the first negative polarity gray-scale voltage in response to the gray-scale value itself of the pixel output from the output circuit, and outputs a video signal having a positive polarity voltage corresponding to the corrected gray-scale value in response to the corrected gray-scale value output from the output circuit, when the gray-scale value of the pixel is the second gray-scale value, the data line driving circuit outputs a video signal having the second positive polarity gray-scale voltage in response to the gray-scale value itself of the pixel output from the output circuit, and outputs a video signal having a negative polarity voltage corresponding to the corrected gray-scale value in response to the corrected gray-scale value output from the output circuit, and the production circuit switches the correction amount candidate groups for use in correcting the gray-scale value of the pixel for every predetermined cycle.

4. The liquid crystal display device according to claim 3, wherein the correction amount candidates included in the correction amount candidate group are correlated to respective different horizontal positions, and the production circuit carries out an interpolation operation based on the correction amount candidate included in the correction amount candidate group, a horizontal position of the pixel, and the horizontal positions correlated to the respective correction amount candidates, to thereby determine a correction amount.

5. The liquid crystal display device according to claim 3, wherein the production circuit determines a correction amount, based on a different correction amount candidate group between a case in which the gray-scale value of the pixel is the first gray-scale value and a case in which the gray-scale value of the pixel is the second gray-scale value.

6. The liquid crystal display device according to claim 2, wherein the predetermined cycle has a length longer than a polarity inversion cycle of the data line driving circuit.

7. The liquid crystal display device according to claim 1, wherein the data line driving circuit corrects the first positive polarity gray-scale voltage and the second negative polarity gray-scale voltage such that an average of the voltage correction amounts becomes larger as a distance of the pixel from the scan line driving circuit decreases.

8. The liquid crystal display device according to claim 7, wherein the data line driving circuit corrects the first positive polarity gray-scale voltage and the second negative polarity gray-scale voltage such that an average of the voltage correction amounts becomes an amount according to a function value of a reduction exponential function including as a variable the distance of the pixel from the scan line driving circuit.

9. The liquid crystal display device according to claim 1, wherein the scan line driving circuit outputs a scan signal to the scan line during a horizontal period having a predetermined length, and the data line driving circuit outputs the video signal during a partial second half period including an ending period of the horizontal period and a signal having a voltage higher or lower than the video signal during a first half period that is a period of the horizontal period excluding the second half period when outputting the positive polarity video signal, and outputs the video signal during the second half period and a signal having the voltage higher or lower than the video signal during the first half period when outputting the negative polarity video signal.

10. The liquid crystal display device according to claim 1, wherein, for every predetermined cycle, the voltage correction amount for the video signal for the pixel is a variable value.

* * * * *